US011578561B2

(12) United States Patent
Garay et al.

(10) Patent No.: US 11,578,561 B2
(45) Date of Patent: Feb. 14, 2023

(54) STINGER FOR ACTUATING SURFACE-CONTROLLED SUBSURFACE SAFETY VALVE

(71) Applicant: Weatherford Technology Holdings, LLC, Houston, TX (US)

(72) Inventors: Serge Garay, Osserain (FR); Glenn A. Bahr, The Woodlands, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 183 days.

(21) Appl. No.: 17/065,298

(22) Filed: Oct. 7, 2020

(65) Prior Publication Data

US 2022/0106858 A1 Apr. 7, 2022

(51) Int. Cl.

| | |
|---|---|
| ***E21B 34/14*** | (2006.01) |
| ***E21B 43/12*** | (2006.01) |
| ***E21B 47/16*** | (2006.01) |

(52) U.S. Cl.

CPC ..... *E21B 34/14* (2013.01); *E21B 43/128* (2013.01); *E21B 47/16* (2013.01)

(58) Field of Classification Search

CPC ..... E21B 34/14; E21B 34/10; E21B 34/16; E21B 34/142; E21B 43/128; E21B 43/13; E21B 47/16; E21B 23/02; E21B 23/042; E21B 23/0418; E21B 23/04; E21B 2200/05; E21B 33/00

See application file for complete search history.

(56) References Cited

U.S. PATENT DOCUMENTS

| | | | | |
|---|---|---|---|---|
| 4,407,363 | A | 10/1983 | Akkerman | |
| 5,564,502 | A | 10/1996 | Crow et al. | |
| 6,302,216 | B1 | 10/2001 | Patel | |
| 6,308,783 | B2 | 10/2001 | Pringle et al. | |
| 7,040,409 | B2 * | 5/2006 | Sangla | E21B 34/10 166/134 |
| 7,392,849 | B2 | 7/2008 | Lauderdale et al. | |
| 7,624,807 | B2 | 12/2009 | Vick, Jr. | |
| 7,954,550 | B2 | 6/2011 | Anderson | |
| 8,616,291 | B2 | 12/2013 | Smith et al. | |

(Continued)

FOREIGN PATENT DOCUMENTS

| | | | | |
|---|---|---|---|---|
| FR | 2734863 | A1 * | 12/1996 | E21B 34/10 |
| WO | 2014151285 | A2 | 9/2014 | |

OTHER PUBLICATIONS

International Search Report dated Jan. 24, 2022, and issued in counterpart International Application No. PCT/US2021/049242.

*Primary Examiner* — George S Gray

(74) *Attorney, Agent, or Firm* — Cabello Hall Zinda, PLLC

(57) ABSTRACT

A system used downhole in tubing is operable with pressure communicated via at least one control line. The system includes a tool and a stinger. The tool disposed with the tubing has a tool bore for passage of tubing flow. The tool has an operator movable between operable states, and the operator has a tool key disposed in the bore. The stinger removably disposed in the tubing is configured to insert into the tool bore. The stinger has an actuator in communication with the at least one control line. Actuated by the control line, a stinger key disposed on the stinger is movable with the actuator between positions. In this way, the stinger key is configured to engage the tool key and is configured to move the tool's operator at least from the one state to another.

25 Claims, 13 Drawing Sheets

(56) References Cited

U.S. PATENT DOCUMENTS

| | | | | |
|---|---|---|---|---|
| 8,640,769 | B2 | 2/2014 | Smith et al. | |
| 8,776,889 | B2 | 7/2014 | Smith et al. | |
| 8,800,668 | B2 | 8/2014 | Bouldin et al. | |
| 8,893,799 | B2 | 11/2014 | Garay | |
| 8,960,298 | B2 | 2/2015 | Hill, Jr. et al. | |
| 9,745,825 | B2 | 8/2017 | Jones et al. | |
| 9,903,181 | B2 | 2/2018 | Myerley et al. | |
| 10,626,703 | B2 | 4/2020 | Johnson | |
| 2004/0026087 | A1 | 2/2004 | Dennistoun et al. | |
| 2009/0050333 | A1 | 2/2009 | Smith et al. | |
| 2009/0205831 | A1 | 8/2009 | Jacob | |
| 2009/0294136 | A1* | 12/2009 | Jones | E21B 34/102 166/386 |
| 2011/0155396 | A1* | 6/2011 | Pinard | E21B 23/04 166/321 |
| 2013/0056222 | A1* | 3/2013 | Smith | E21B 17/1035 166/242.6 |
| 2014/0224503 | A1 | 8/2014 | Smith et al. | |
| 2014/0262303 | A1 | 9/2014 | Smith et al. | |
| 2018/0334883 | A1 | 11/2018 | Williamson | |
| 2019/0145220 | A1* | 5/2019 | Patel | E21B 34/10 166/375 |
| 2019/0376366 | A1 | 12/2019 | Burris et al. | |
| 2019/0376367 | A1 | 12/2019 | Burris et al. | |
| 2020/0048988 | A1 | 2/2020 | Vick, Jr. | |

* cited by examiner

STINGER FOR ACTUATING SURFACE-CONTROLLED SUBSURFACE SAFETY VALVE

BACKGROUND OF THE DISCLOSURE

In some completions, a control fluid or another injectable fluid may be delivered downhole to a mandrel, a safety valve, or some other tool. In many installations, a control line, such as a capillary or another hydraulic line, cannot be run outside the tubing string. Instead, the control line must be run down the tubing string to deliver the fluid from the surface to the downhole tool. In some instances, for example, an existing control line run outside the tubing string may become damaged or inoperable so a new surface-controlled subsurface safety valve must be run down the tubing string. Because the damaged control line outside the tubing cannot be used and because a new control line cannot be run outside the tubing, a new control line must be run down the tubing string to control the new surface-controlled subsurface safety valve.

In this example, the new surface-controlled subsurface safety valve can install in the well, which has existing hardware for a surface-controlled valve. The safety valve can be deployed in the well using standard wireline procedures. When run in the well, the valve lands in an existing landing nipple. This connection between the coupling and port communicates hydraulic fluid with a piston chamber of the safety valve. In particular, the port can communicate hydraulics from a control line to a hydraulic chamber used to control a flapper valve on the safety valve.

A typical method for delivering the hydraulics to the safety valve uses a stinger or a receptacle positioned in the flow bore of the safety valve so a control line can make the connection to the safety valve there. For example, a receptacle can be positioned in the flow bore of the safety valve, and a stinger of the control line can be stabbed into a receptacle for the connection to communicate the hydraulic fluid. In a reverse arrangement, a stinger can be positioned in the flow bore of the safety valve, and a Staubli-style receptacle on the hydraulic line can be stabbed down over the receptacle.

Although existing techniques may be useful and effective, leaking of the hydraulic pressure and proper sealing of the control line to the safety valve can pose a number of issues. The subject matter of the present disclosure is directed to overcoming, or at least reducing the effects of, one or more of the problems set forth above.

SUMMARY OF THE DISCLOSURE

A system is used downhole in tubing having tubing flow and is operable with pressure communicated via at least one control line. The system comprises a tool disposed with the tubing and comprises a stinger removably disposed in the tubing.

The tool has a tool bore for passage of the tubing flow therethrough. The tool has an operator movable between first and second states. The operator has a first key disposed in the tool bore. The stinger is configured to insert at least partially into the tool bore of the tool. The stinger defines a flow bore for passage of the tubing flow therethrough. The stinger has an actuator in communication with the at least one control line. The actuator has a second key disposed on the stinger. The second key is movable with the actuator between first and second positions. The second key is configured to engage the first key of the tool and is configured to move the operator at least from the first state to the second state.

The operator of the tool can comprise a valve being operable by the stinger to open from the first state to the second state. The valve in the first state can restrict the tubing flow through the tool bore, and the valve in the second state can permit the tubing flow through the tool bore.

The valve can comprise a flapper and a flow tube. The flapper can be disposed in the tool bore and can be pivotable between an opened position (for the first state) and a closed position (for the second state) relative to the tool bore. The flow tube can be disposed in the tool bore and can be movable therein between third and fourth positions to pivot the flapper respectively between the opened and closed positions. The flow tube can define a key profile exposed therein for the first key.

The flapper can comprise a torsion spring biasing the flapper toward the closed position. The flow tube can comprise a compression spring biasing the flow tube toward the third position.

The tool, being disposed with the tubing, can be disposed on the tubing or can be disposed in the tubing.

The stinger can comprise a first lock disposed thereon and engageable in an internal groove in the tool bore. Additionally or alternatively, the tool can comprise a second lock disposed in the tool bore and engageable in an external groove on the stinger.

The actuator can comprise a piston disposed in a piston chamber in communication with the at least one control line. The piston can have the second key disposed thereon, and the piston can be movable in the piston chamber in response to the pressure from the at least one control line.

The piston can be sealed in the piston chamber of the stinger between a first of the at least one control line and a second of the at least one control line. The piston can be movable with a differential in the pressure between the first and second control lines.

The piston can be sealed in the piston chamber of the stinger between the at least one control line and a pressure volume. The piston can be movable with a differential in the pressure between the at least one control line and the pressure volume.

The stinger can define a slot adjacent the piston chamber, and the first key can be disposed in the slot and connected to the piston.

The system can comprise a biasing element biasing the second key on the piston outward from the slot of the stinger.

The second key can comprise a male profile, and the first key can comprise a female profile. The male profile can be configured to mate in a first direction with the female profile and can be configured to unmate from the female profile in a second direction opposite to the first direction.

The system can further comprise a hydraulic apparatus having a first pump connected in communication with a first of the at least one control line. The first pump can provide the pressure for a first side of the piston in the piston chamber.

The hydraulic apparatus can comprise a reservoir or a second pump. The reservoir can be connected in communication with a second of the at least one control line, and the second control line can be connected in communication with a second side of the piston in the piston chamber. The second pump can be connected in communication with the second control line and can provide the pressure for the second side of the piston in the piston chamber.

The stinger can further comprise a pressure volume being connected in communication with a second side of the piston in the piston chamber.

The system can further comprise: a power source disposed in the tubing; and an electric pump disposed in the tubing and disposed in electrical communication with the power source, the electric pump providing the pressure for the at least one control line.

As disclosed herein, a stinger is used for actuating a downhole tool using pressure communicated via at least one control line. The downhole tool is disposed with or in tubing, and the control line runs through the tubing. The downhole tool has a tool bore for passage of tubing flow therethrough, and the tool has a first key exposed in the tool bore.

The stinger comprises a body, a piston, and a second key. The body is configured to insert at least partially into the tool bore of the downhole tool. The body defines a body bore for passage of the tubing flow therethrough, and the body defines a piston chamber therein in communication with the at least one control line. The piston is disposed in the piston chamber and is movable therein in response to the pressure. The second key is connected to the piston and is exposed on the body. The second key is engageable with the first key and is moved with the piston between first and second positions.

The piston can be sealed in the piston chamber of the body between a first of the at least one control line and a second of the at least one control line. The piston can be movable with a differential in the pressure between the first and second control lines.

The piston can be sealed in the piston chamber of the body between the at least one control line and a pressure volume. The piston can be movable with a differential in the pressure between the at least one control line and the pressure volume.

According to the present disclosure, a method is used for use in tubing having tubing flow. The method comprises: installing a tool downhole with respect to the tubing, the tool having a tool bore for communicating the tubing flow; connecting a stinger to at least one control line; running the stinger downhole in the tubing to the tool; inserting the stinger at least partially in the tool bore; engaging a second key on the stinger with a first key exposed in the tool bore; moving the second key connected to a piston in a piston chamber of the stinger by communicating pressure in the at least one flow line relative to the piston chamber; and mechanically operating a function of the tool from at least a first state to a second state by moving the first key of the tool from at least a first position to a second position using the second key of the piston.

The foregoing summary is not intended to summarize each potential embodiment or every aspect of the present disclosure.

DETAILED DESCRIPTION OF THE DISCLOSURE

Figure 1A:
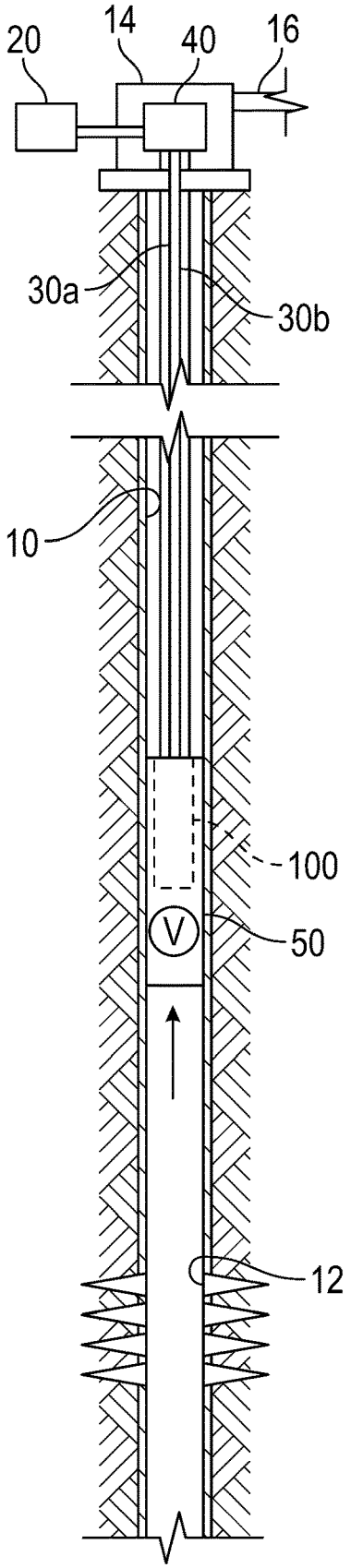
FIG. 1A illustrates a schematic view of a downhole tool operated by control lines according to the present disclosure.

FIG. 1A illustrates a schematic view of tubing 10 having a downhole tool 50 disposed therewith. The tubing 10 can be a casing string, a production string, etc. Here, the downhole tool 50 is a surface-controlled, subsurface safety valve disposed in the tubing 10. In a further example, the safety valve 50 can be deep-set, using dual control lines 30*a-b* that hang from a hanger 40 at a wellhead 14 and that run down through the tubing 10. A hydraulic system 20 at surface communicates with the control lines 30*a-b* to control the safety valve 50.

During normal operation, the hydraulic system 20 maintains hydraulic pressure in the control lines 30*a-b*. Hydraulic pressure from the hydraulic system 20 maintains the safety valve 50 open, allowing production from the formation to flow uphole past the safety valve 50, through the wellhead 14, and out a flow line 16 to a destination. Under certain conditions, however, the hydraulic system 20 releases the hydraulic control so that the safety valve 50 closes and prevents tubing flow uphole. Using techniques known in the art, for example, the hydraulic system 20 monitors flow line pressure sensors and automatically closes the safety valve 50 in response to an alarm condition requiring shut-in.

To close the safety valve 50, the hydraulic system 20 removes the hydraulic pressure applied to the safety valve 50 by exhausting the hydraulic fluid from the safety valve 50 via at least one of the control lines 30*a-b*. The safety valve 50, which is normally closed, then automatically closes, preventing production fluid from perforations 12 or the like from communicating uphole to the wellhead 14.

To connect the control lines 30*a-b* to the downhole tool 50, a stinger 100 disposed in the tubing is configured to insert or stab at least partially into a tool bore of the downhole tool 50. The stinger 100 also defines a flow bore for passage of the tubing flow therethrough so the stinger 100 can remain inserted during normal operation of the safety valve 50. The control lines 30*a-b* connect to components of the stinger 100, which is operable to actuate the downhole tool 50 as disclosed herein.

Figure 1B:
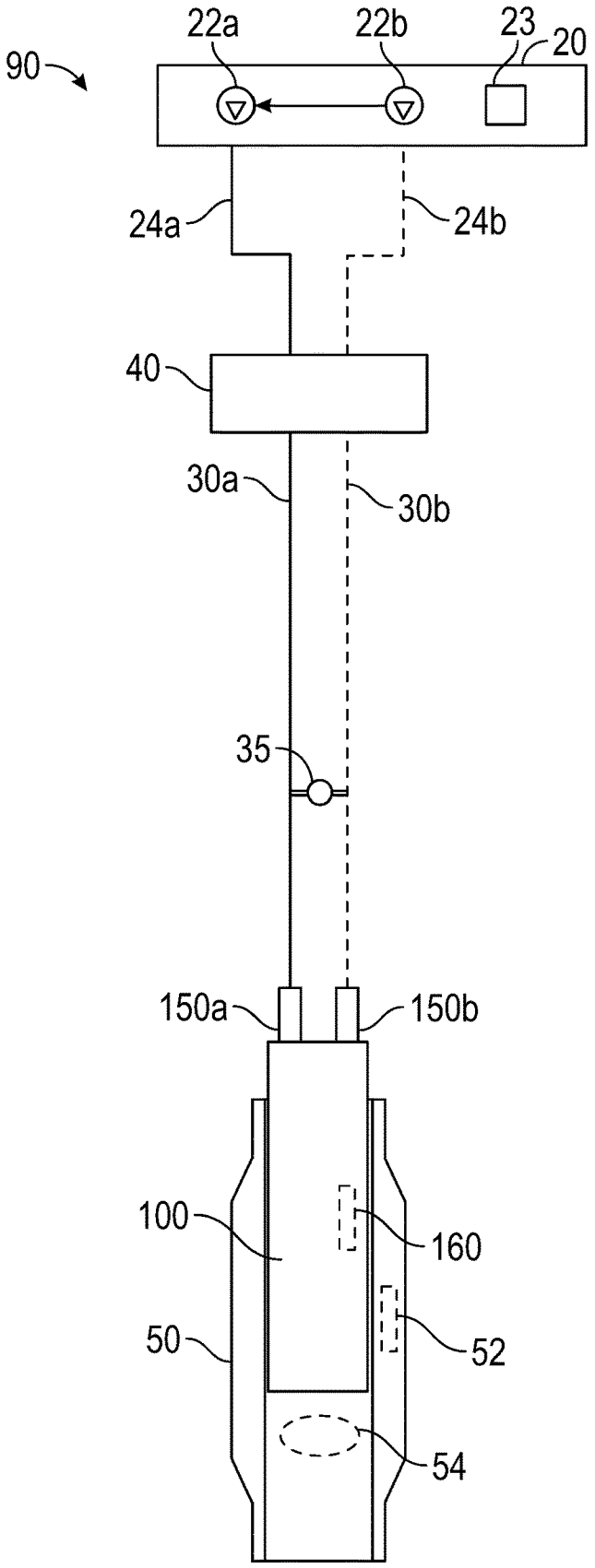
FIG. 1B illustrates a control line system for a stinger used in a downhole tool according to the present disclosure.

FIG. 1B illustrates a control line system 90 for connecting a hydraulic system 20 at surface to an actuator 160 of a stinger 100 according to the present disclosure. Two control lines 30*a-b* extend from the wellhead 40 and down the well to the stinger 100, which positions in a deep-set safety valve 50 or the like. Depending on the implementation, one or more connection lines 24*a-b* couple from the hydraulic system 20 for passing to the wellhead 40 and connecting to the extended control lines 30*a-b* using hanger arrangements.

In one configuration, each control line 30*a-b* communicates with a pump 22*a-b* of the hydraulic system 20, and each control line 30*a-b* can be separately operable with pressure. Using this configuration, personnel can actuate the downhole tool 50 (e.g., open and close the deep-set safety valve 50) in both directions with hydraulic fluid from the control lines 30*a-b* being separately operated with the hydraulic system 20.

In an alternative, one control line 30*a* can be pressurized by a pump 22*a* to actuate the actuator 160 on the stinger 100, while the other control line 30*b* is connected to a reserve or a tank 23. Either way, one of the control lines (e.g., 30*b*) can act as a balance line. This balance line 30*b* can offset the hydrostatic pressure in the primary control line 30*a*, allowing the safety valve 50 to be set at greater depths.

As an alternative to running the control line to surface, the balance control line 30*b* can be terminated or capped off below the wellhead 40 or can connect to a pressure chamber (not shown) below the wellhead 40. Thus, only the primary control line 30*a* may run to the surface and the hydraulic system 20, while the balance control line 30*b* for offsetting the hydrostatic pressure terminates below the wellhead 40.

For its part, the downhole tool 50 in FIGS. 1A-1B can include an operator 52 that operates a function 54 of the tool 50 between first and second states. As a safety valve, for example, the operator 52 can include a flow tube for opening and closing a flapper 54, which is normally biased closed on the tool 50.

The primary or active control line 30*a* can connect at a first connection 150*a* to the stinger 100 in communication with one side of the actuator 160, while the second or balance control line 30*b* can connect at a second connection 150*b* to the stinger 100 in communication with the other side of the actuator 160. The connections 150*a-b* can use jam nuts or other suitable hydraulic connection.

The primary control line 30*a* can be charged with hydraulic pressure against the actuator 160. Meanwhile, the hydraulic pressure from the balance control line 30*b* can offset the hydrostatic pressure in the primary control line 30*a* by acting against the opposing side of the actuator 160. Therefore, this offsetting pressure negates the effects of the hydrostatic pressure in the primary control line 30*a* and enables the tool 50 to operate at greater setting depths.

If the balance control line 30*b* loses integrity and if insufficient annular pressure is present to offset the primary control line's hydrostatic pressure, then the tool 50 can fail in an opened position, which may be unacceptable. To overcome unacceptable failure, the control system 90 can include a fail-safe device or regulator 35 disposed at some point down the well. The regulator 35 interconnects the two control lines 30*a-b* to one another and acts as a one-way valve between the two lines 30*a-b*.

As can be seen, the downhole tool 50 can be a safety valve or other tool that is not directly operated using hydraulics. Instead, the control system 20 connects directly to the connectors (150*a-b*) on the stinger's actuator 160, which can mechanically operate the operation of the downhole tool 50. Fluid is not communicated from the stinger 100 to the downhole tool 50. This removes the need for seals between the stinger 100 and the tool 50. In other words, the stinger 100 uses a physical link to operate the tool 50 so that hydraulic seals are not needed between the stinger 100 and tool 50.

Figure 2:
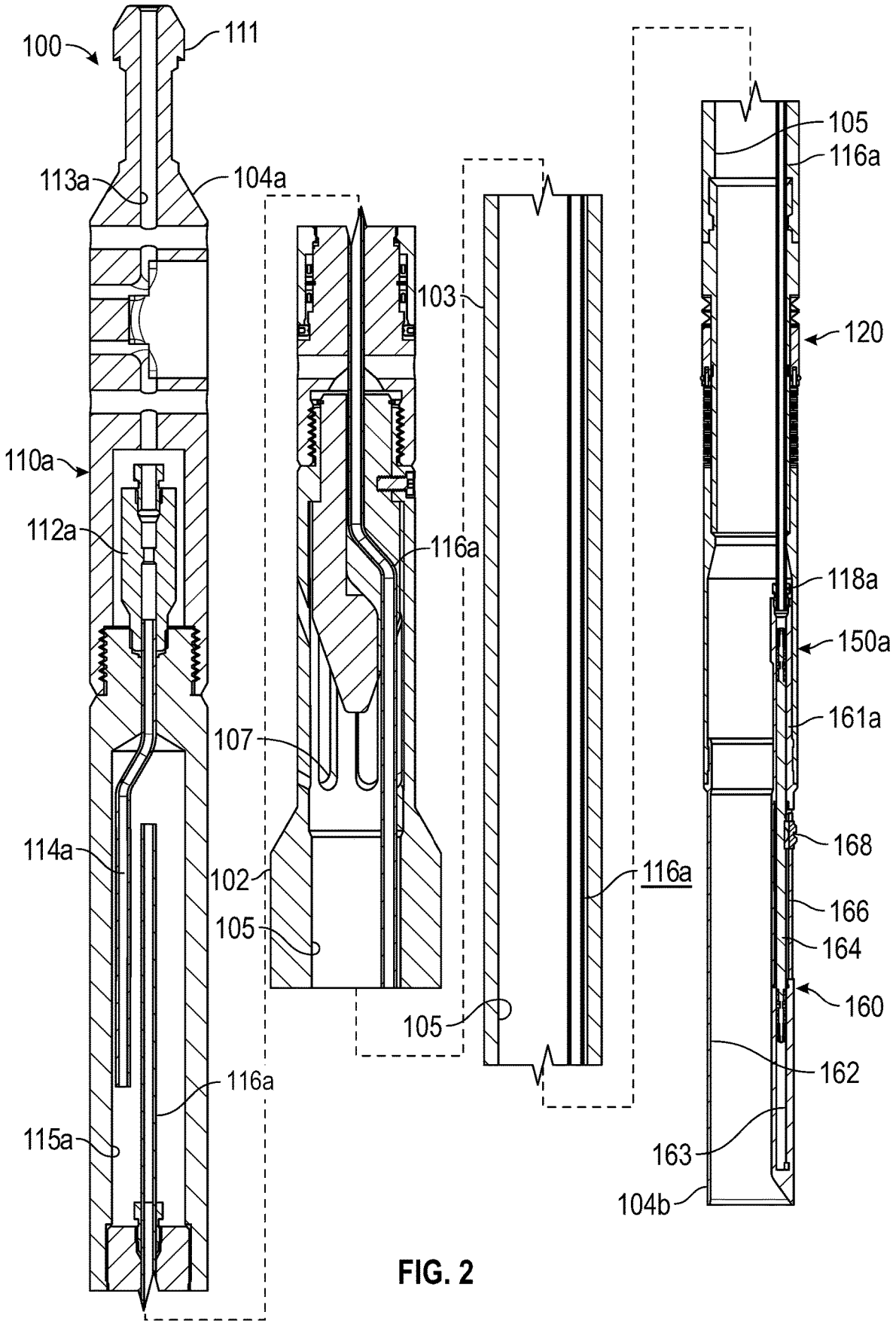
FIG. 2 illustrates a cross-section of a stinger according to the present disclosure for actuating a downhole tool using hydraulics.

FIG. 2 illustrates a cross-section of a stinger 100 for communicating fluid (e.g., hydraulics, pressure, etc.) from at least one control line (e.g., 30*a-b*) to a downhole tool (e.g., 50). As discussed herein, the downhole tool (50) can be a surface-controlled, subsurface safety valve operated with hydraulics from at least one hydraulic control line (30*a-b*) connected to the stinger 100. For example, FIG. 4A-4D illustrates a cross-section of the disclosed stinger 100 installed in a surface-controlled, subsurface safety valve 200. As will be appreciated, an existing safety valve in a well may become inoperable. To rectify the problem, personnel can deploy a surface-controlled safety valve 200 in the tubing of the well. The surface-controlled safety valve 200 can be landed inside the existing tubing-mounted safety valve, in a tubing-mounted safety valve landing nipple, or in another part of the tubing string depending on the type of surface-controlled safety valve used. Using the stinger 100, at least one hydraulic control line (30*a-b*) can then be run down the tubing and connected to the installed safety valve 200 for operation.

As shown in FIG. 2, the stinger 100 includes a body or housing 102, which can be made up of various interconnecting components for assembly purposes. Overall, the stinger's body 102 has a proximal end 104*a* and a distal end 104*b* and defines a flow bore 105 therethrough. The body 102 connects to at least one control line (30*a-b*; FIG. 1A-1B), such as a capillary line run from a wellhead hanger at surface.

The proximal end 104*a* can include a wireline head 111 having a line support 113*a* for at least one control line (30*a-b*) to connect internally to a fluid connection 110*a*. The flow bore 105 allows for flow through the stinger's body 102 between the open distal end 104*b* and flutes 107 at the proximal end 104*a*.

The distal end 104*b* includes an actuator 160 that communicates with the pressure from the at least one control line (30*a-b*) at the proximal end 104*a*. As discussed below, the distal end 104*b* is inserted/stabbed into a bore opening of a downhole tool (e.g., safety valve, mandrel, etc.) so the actuator 160 can be placed adjacent to mechanical components of the downhole tool for the purposes of actuating a function of the tool.

To communicate the pressure from the at least one control line (30*a-b*) at the proximal end 104*a* to the actuator 160 at the distal end 104*b*, the fluid connection 110*a* includes a coupling 112*a* of a first flow passage or conductor 114*a* to the at least one control line (30*a-b*). The first conductor 114*a* can communicate from the coupling 112*a* to a syphon chamber 115*a* in the body 102. A second flow passage or conductor 116*a* can communicate the chamber 115*a* downstream with the actuator 160.

The first conductor 114*a* has a first connected end at the coupling 112*a* and has a first free end disposed in the syphon chamber 115*a*. The second conductor 116*a* has a second free end disposed in the syphon chamber 115*a* and has a second connected end at a second coupling 150*a*. For example, the second conductor 116*a* can pass along the sidewall of the flow bore 105 of the body 102, and an end of the lower conductor 116*a* can connect to an internal coupling 150*a* discussed below, which then communicates internally to the stinger's actuator 160. The internal coupling 150*a* disposed in the stinger's flow bore 105 is shown. The flow conduit 116*a* that runs along the flow bore 105 connects by a fitting 118*a* to an exposed fitting head 161*a* inside the flow bore 105. As mentioned below, only one fluid connection 110*a* is described here, but the other fluid connection (not shown) would be comparably configured. Therefore, it will be appreciated that there is preferably a separate syphon for each line in the arrangement.

The syphon chamber 115*a* can help keep the control fluid substantially free of debris and contamination. For example, debris will tend to settle at the bottom of the chamber 115*a*. If the stinger 100 is at a grade (i.e., is non-vertical), the chamber 115*a* will tend to keep the collected debris from inadvertently entering through the open end of the conduit 116*a* that communicates to the stinger's actuator 160. Should filtering be necessary, the syphon chamber 115*a* can house a filter (not shown) for filtering the control fluid, but filtering may not be suitable in some implementations.

As shown, the internal coupling 150*a* is disposed off the central axis in the flow bore 105 of the body 102, which can reduce the restriction to the flow bore 102 and can reduce the creation of flow turbulence in production fluid or the like flowing up through the assembly. Sealing of the fluid path along the conduits 114*a*, 116*a* uses connectors 118*a*, 150*a* that can have hydraulic fittings to seal the conduits 114*a*, 116*a*. For example, the connectors 118*a*, 150*a* can have a jam nut and ferrules to crimp and seal the conduits 114*a*, 116*a* in ports, receptacles, or the like of the stinger's body 102.

Although one arrangement of a fluid connection 110*a* (e.g., coupling 112*a*, first flow conductor 114*a*, syphon chamber 115*a*, second conductor 116*a*) connects to an internal coupling 150*a* on the actuator 160, additional fluid connections can be provided for additional control lines, such as a balance control line (e.g., 30*b*; FIGS. 1A-1B). In particular and as discussed herein, the actuator 160 of the present disclosure can operate using two control lines (30*a*-*b*; FIGS. 1A-1B) so that separate fluid connections 110 and internal couplings 150 can be provided for each on the stinger 100. This may be achieved with a duplicate fluid connection, which can have one or more of the features of the primary fluid connection 110*a*.

As shown in FIG. 2, the actuator 160 on the distal end 104*b* of the body 102 has a cylindrical sleeve 162 having a throughbore that communicates with the stinger body 102. Stems or fitting heads (one shown 161*a*) extend from the sleeve 162 of the actuator 160 where the sleeve 162 connects to the stinger body 102. These fitting heads (161*a*) connect to the internal couplings 150*a* and flow connections 110*a* for conveying the hydraulic fluid and pressure to the actuator 160. Internally, the actuator 160 includes a piston chamber 163 in which a rod piston 164 is moveable. A biased key 168 (pushed by a spring 172) can be moved by the rod piston 164 in an external slot 166 defined on the outside of the actuator's sleeve 162. This arrangement is used for mechanically actuating components of a downhole tool, such as a subsurface safety valve of the present disclosure.

Figure 3A:
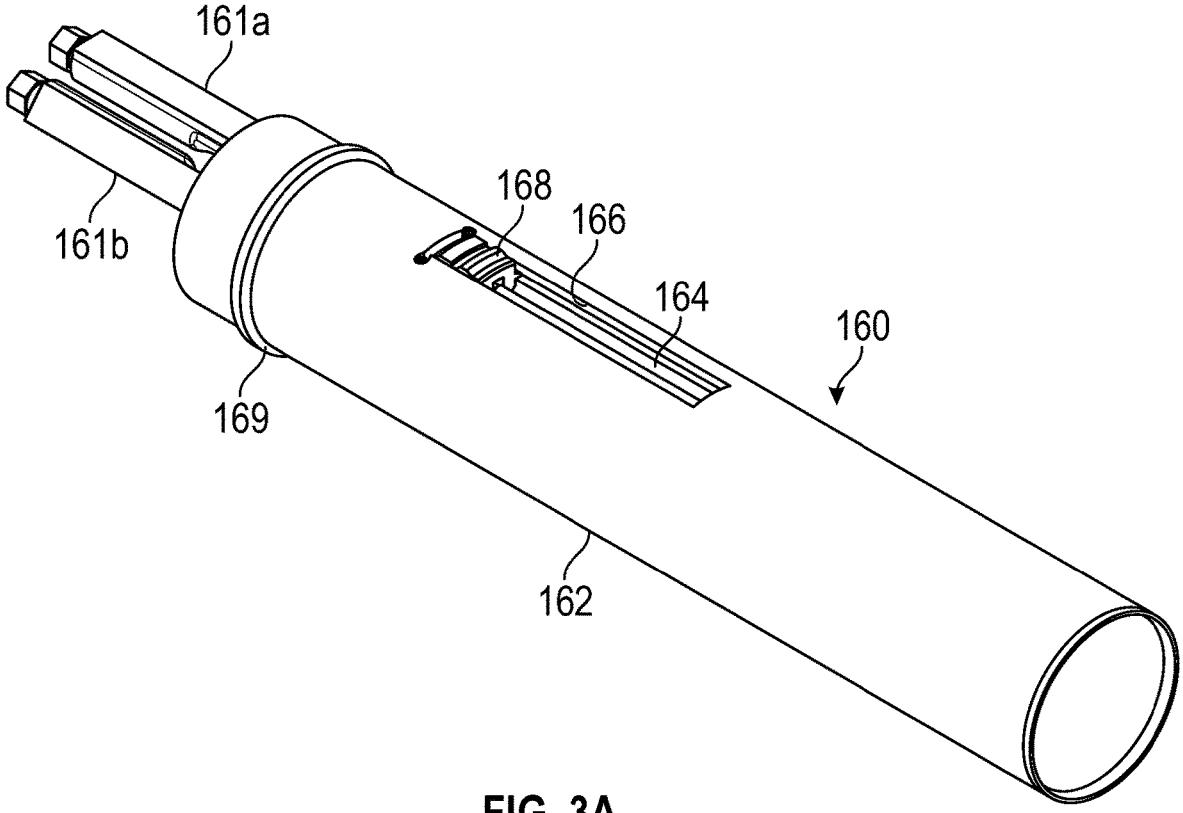
FIGS. 3A-3B illustrate perspective views of an actuator for the disclosed stinger.

FIG. 3A shows a perspective view of the actuator 160 in isolation. As can be seen, the cylindrical sleeve 162 of the actuator 160 has stems or fitting heads 161*a*-*b* for connection to the hydraulic conduits for two control line communications. The key 168 is disposed on the rod piston 164, which can move the key 168 along the external slot 166 of the actuator 160.

Figure 3B:
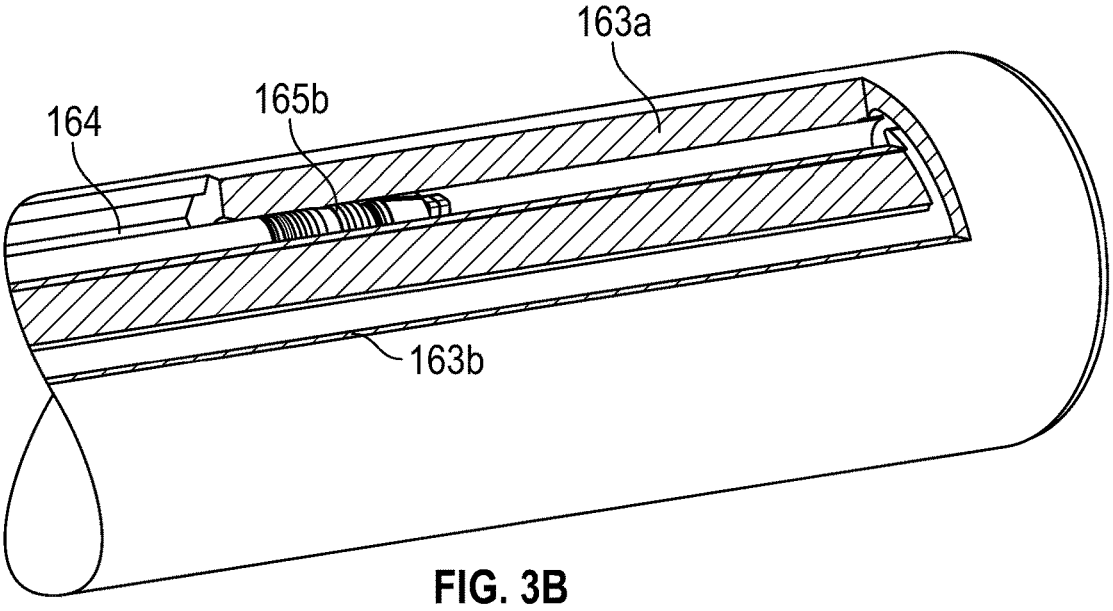

FIG. 3B shows a perspective view of a portion of the actuator 160 with the piston chamber 163 exposed. The rod piston 164 is movable in a main chamber portion 163*a* connected to a first hydraulic connection at the fitting head 161*a*. The main chamber portion 163*a* communicates with a second chamber portion 163*b*, which is connected to a second hydraulic connection at the second fitting head 161*b*. Each end of the piston 164 is sealed in the piston chamber 163 using seal stacks 165*a*-*b* at each end. In this way, fluid pressure communicated at the first head 161*a* and released at the second head 161*b* allows the rod piston 164 to move downward along the actuator 160. Likewise, fluid pressure communicated (or existing hydrostatic pressure) at the second head 161*b* and fluid pressure released at the first head 161*a* allow the rod piston 164 to move upward along the actuator 160.

A number of techniques can be used to fabricate and construct the actuator 160. Preferably, however, the actuator 160 with its sleeve 162, chamber 163, slot 166, stems 161*a*-*b*, and the like is fabricated using 3D printing and machining techniques. Preferably, the actuator 160 has a unitary construction without the need for threaded connections, seals, and the like. This can limit the potential leak paths in the actuator 160. Essentially, the hydraulics communicated at the couplings on the stems 161*a*-*b* encounter the chamber 163 having smooth bore walls without divisions or interconnects. Therefore, sealing of the hydraulics for the actuator 160 is limited to the seals 165*a*-*b* on the piston 164 engaging the walls of the chamber 163 and can be limited to any bushings or seals disposed at the openings of the chamber 163 to the slot 166 through which the ends of the piston 164 extend.

With an understanding of the stinger 100, discussion turns to use of the stinger 100 with a downhole tool in the form of a surface-controlled, subsurface safety valve. For example, FIGS. 4A-4D illustrates a cross-section of the disclosed stinger tool 100 stabbed into a flow bore 205, bore opening, or receptacle in the downhole tool 200. As shown here, the downhole tool 200 can be a surface-controlled, subsurface safety valve.

The safety valve 200 can be set inside a downhole tubular (not shown) in a manner known in the art. For instance, the valve 200 can be deployed down the tubing of the well that has or does not have a safety valve nipple. Depending on the implementation, the safety valve 200 can be set in the tubing before stabbing by the stinger 100. Here, in this example, the safety valve 200 is first set downhole in the tubing (not shown), and the stinger 100 is then installed to make the hydraulic connection.

For example, the surface-controlled, subsurface safety valve 200 shown here is set mechanically downhole in a tubular (not shown). Briefly, the safety valve 200 has a housing 202 with a landing portion 210 and an operator 260 (i.e., safety valve portion). The landing portion 210 on the upper end of the valve 200 is movable on a stem 222 extending from a lower housing portion 220. The landing portion 210 can use slips 214 movable on the housing 202 between engaged and disengaged positions relative to a downhole tubular in which the valve 200 lands.

The operator or safety valve portion 260 of the safety valve 200 is connected below the lower housing 220 and includes the safety valve components noted herein. In general, the operator 260 has a flow tube 264 and a flapper 270. The flow tube 264 can move longitudinally in a distal valve body 261 of the valve portion 260 and is biased by a compression spring 266. The flapper 270 is rotatably disposed on the valve body 261. The flapper 270 rotates on a pivot pin 272, and a torsion spring 274 biases the flapper 270 to a closed position.

In deploying the valve 200 without the stinger 100 installed, a conventional wireline running tool (not shown) couples to the profile in the upper end of the valve's housing 202 and lowers the valve 200 to the desired location. When in position, the running tool actuates the landing elements to set the tool 200 in a downhole tubular.

To set the tool 200, the upper housing 210 can be moved along the stem 222 toward the lower housing 220, and a body lock ring 212 engaged between the stem 222 and the upper housing 210 can prevent reverse upward movement. Setting the tool 200 can be achieved using known techniques, such as using the wireline setting tool to move the housing 210 and the setting stem 222 relative to one another. In the setting process, the slips 214 engaged between upper and lower cones 216*a-b* between the upper and lower housing 210, 220 can be wedged outward to engage the surrounding surface of the tubular. Bias from a spring 218 on the upper housing 210 can be provided for the upper cone 210 to facilitate the setting. Once landed, one or more external seals, such as chevron seal 269, on the housing 202 can seal against the tubular wall. Other configurations for setting the tool 200 can be used.

Either way, the surface-controlled subsurface safety valve 200 can be installed in a well that either has or does not have existing hardware for a surface-controlled valve. The fluid control line can then be run downhole so the disclosed stinger 100 can connect to the valve 200 and communicate hydraulic fluid to operate the stinger, which then actuates the valve 200 for operation.

With the valve 200 landed, for example, operators lower at least one fluid control line (not shown) with the stinger 100 on the end downhole to the valve 200. This at least one control line can be hung from a capillary hanger (not shown) at the surface. The stinger's distal end 104*b* passes into the bore 205 of the valve's housing 202 and makes a connection inside the valve 200 to control the valve 200.

Figure 4A:
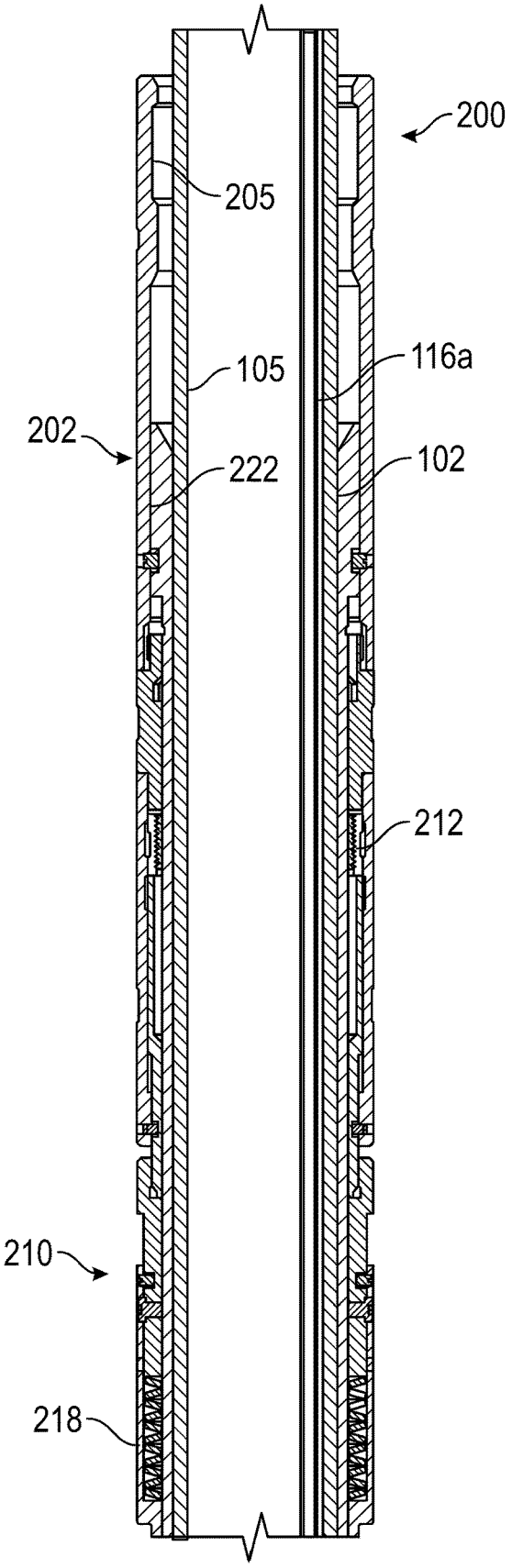
FIGS. 4A-4D illustrate cross-sectional views of the disclosed stinger stabbed into a surface-controlled subsurface safety valve.
Figure 4B:
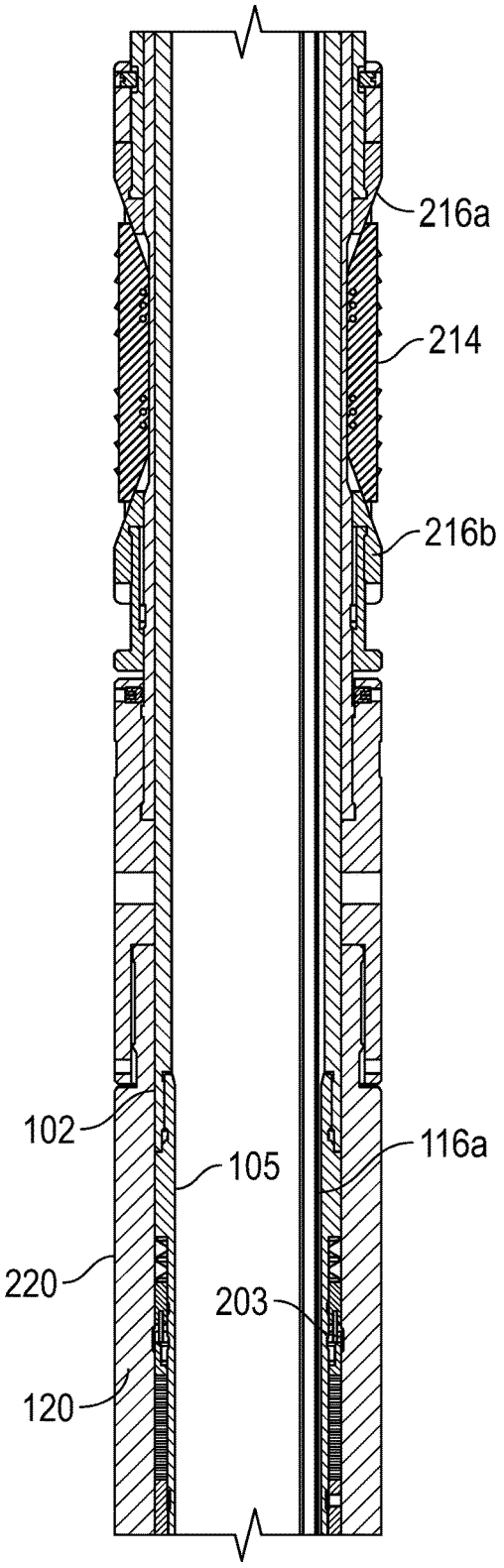
Figure 7:
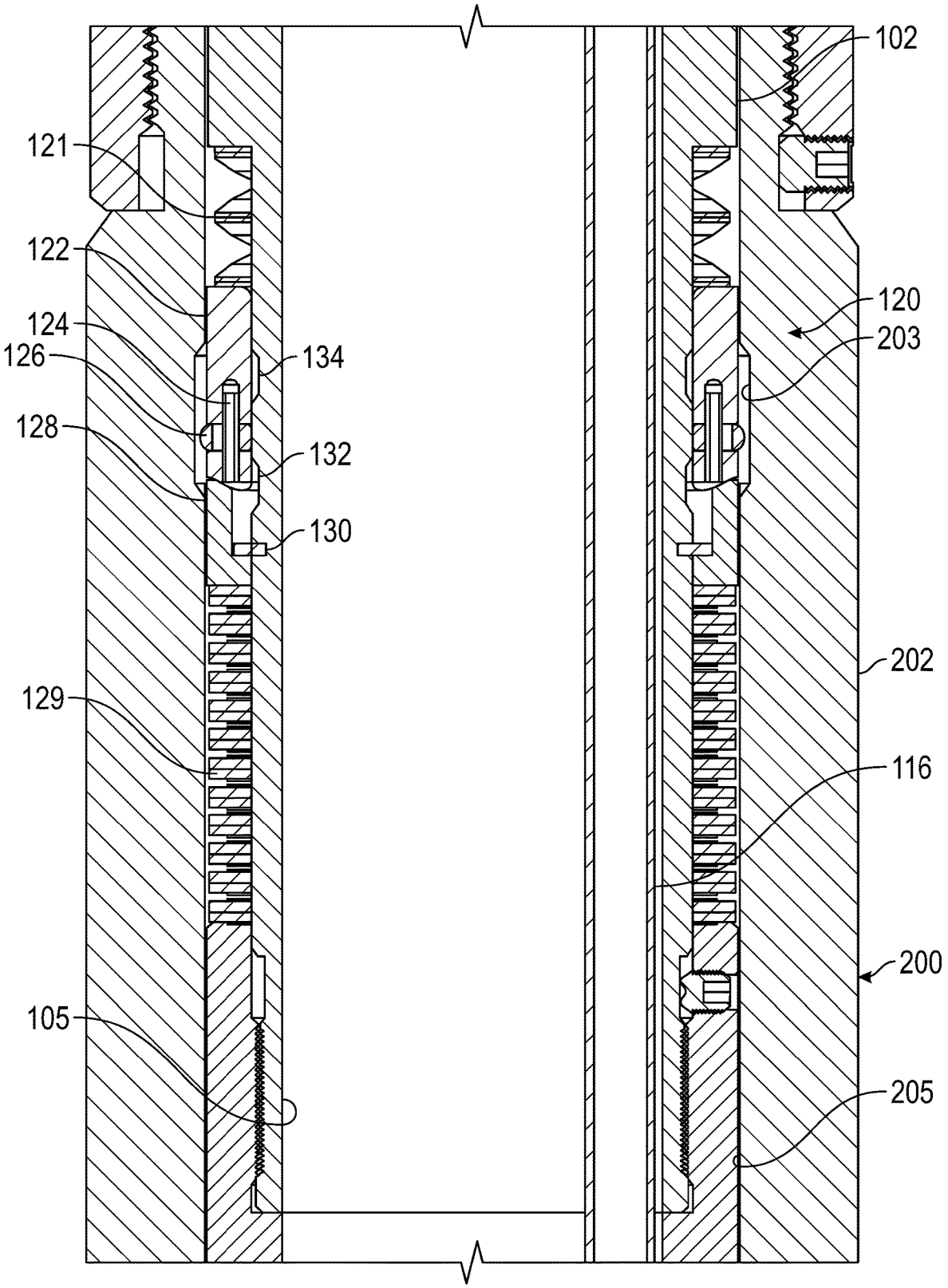
FIG. 7 illustrates an isolated section of FIG. 4B, highlighting particular details associated with a lock for the stinger.

The stinger 100 can include a lock for engaging inside the valve 200, and/or the valve 200 can include a lock for engaging the stinger 100 therein. As shown in FIG. 4B and in further detail in FIG. 7, for example, the stinger 100 can include a lock 120 that uses a strong spring and key configuration to retain the stinger 100 in the safety valve 200. As shown in FIGS. 4B and 7, the lock 120 includes a drag collar 122 movably disposed on the body 102 and biased toward a first position on the body 102. In particular, a first biasing element 121 pushes the drag collar 122 toward a push collar 128, which is itself pushed in an opposite direction by a second biasing element 129 The biasing elements 121, 129 can be wire springs, wave springs, set of bevel springs, set of disc springs, or the like. A snap ring 130 on the tool body 102 prevents further movement of the push collar 128 past it. The drag collar 122 includes a shifting dog 126 disposed on the collar 122. In particular, the shifting dog 126 can shift between an extended condition and a retracted condition on a cross pin 124 of the drag collar 122. A plurality of such shifting dogs 126 may be arranged around the circumference of the drag collar 122. Details of such a lock 120 are disclosed in co-pending U.S. application Ser. No. 16/552,878, filed 27 Aug. 2019 and entitled "Stinger for Communicating Fluid Line with Downhole Tool," which is incorporated herein by reference in its entirety.

For its part, the stinger body 102 defines first and second external grooves 132, 134 spaced from one another. Depending on how the dogs 126 are shifted by the sidewall of the bore opening 205 of the tool body 202, the dogs 126 can shift to the retracted condition into either of the first and second external grooves 132, 134. Moreover, depending on how the dogs 126 are shifted by the sidewall of the stinger body 102, the dogs 126 can shift to the extended condition into the internal groove 203 of the tool's bore opening 205.

Figure 4C:
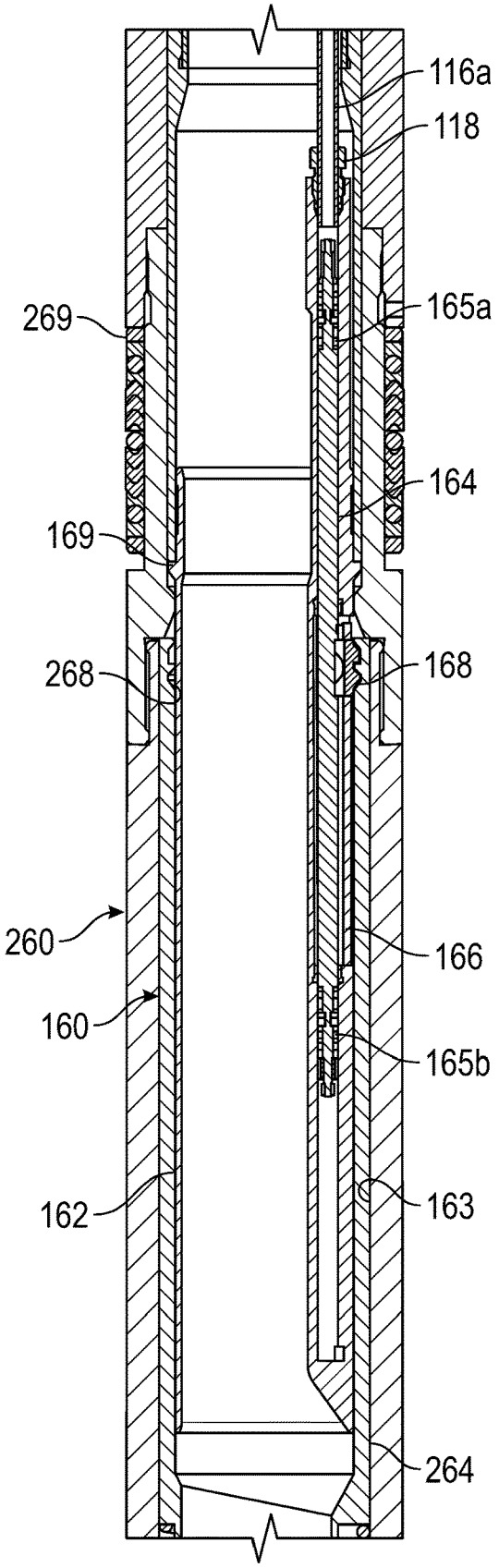
Figure 4D:
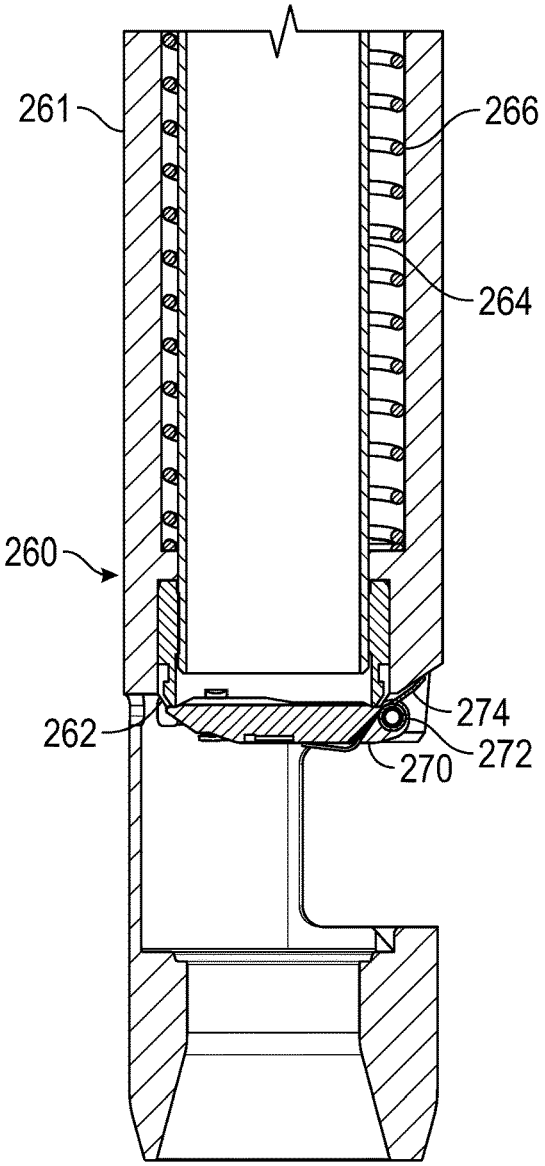
Figure 5A:
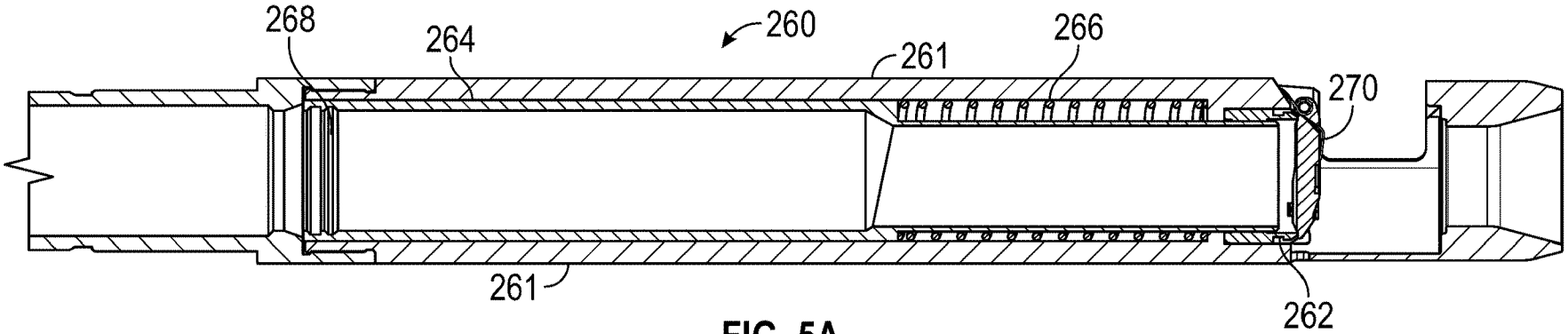
FIG. 5A illustrates an isolated section of the safety valve having a flapper valve, a spring, and a flow tube with a key profile.
Figure 5B:
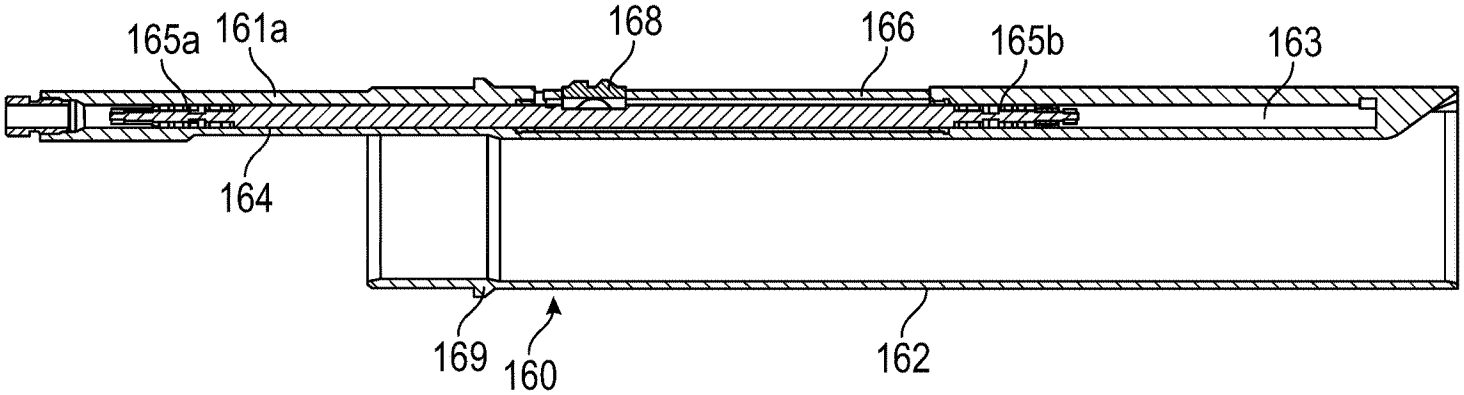
FIG. 5B illustrates an isolated section of the actuator for the disclosed stinger.

Once the stinger 100 is stabbed into the valve 200 as shown in FIG. 4C-4D, the actuator 160 installs into the operator 260 of the safety valve 200. As noted, the operator 260 includes the flow tube 240 movable disposed in the housing 202 and include the flapper 270 rotatably disposed on the housing 202. The flapper 270 rotates on the pivot pin 272, and a torsion spring 274 biases the flapper 270 to a closed position against a seat 262. The flow tube 264 installed in the bore 205 of the safety valve 200 is biased by the biasing element or compression spring 266 so the flapper 270 is normally biased closed. Shifting the flow tube 264 against the bias of the spring 266 opens the flapper 270 and opens fluid communication with the valves' distal end.

The flow tube 264 includes a first key 268 disposed internally thereon. As shown, the first key 268 is preferably a key profile defined as a groove circumferentially inside the flow tube 264. The key profile 268 can be disposed at an uphole end of the flow tube 264, which can provide more space for other components on the stinger 100. Other configurations are possible, where the key profile 268 is disposed at a downhole end or an intermediate position, which may have advantages in other implementations.

With the actuator 160 stabbed into the operator 260, the sleeve 162 of the actuator 160 can fit into the flow bore of the flow tube 264. Sealing is not strictly necessary, which is contrary to what is typically required when running a control line and a stinger. The key 168 on the actuator 160 engages the key profile 268 on the valve's flow tube 264. Details of this engagement are discussed later.

Figure 6A:
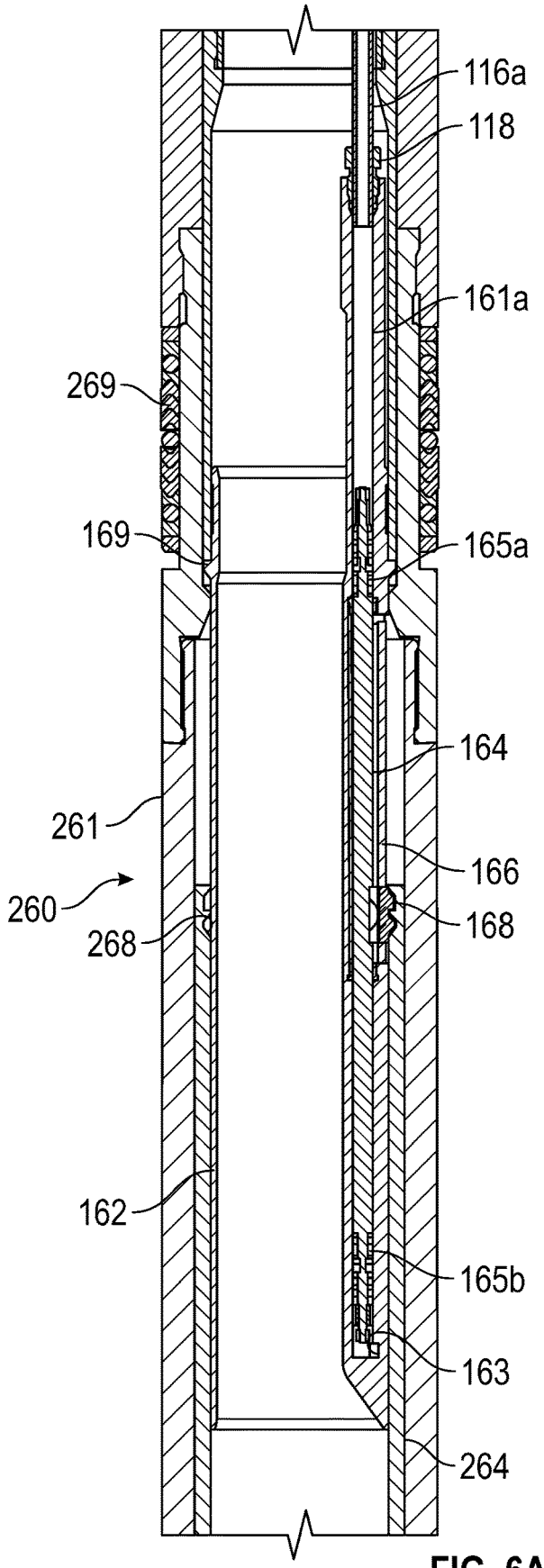
FIGS. 6A-6B illustrate cross-sectional views of the disclosed stinger stabbed into and opening the surface-controlled subsurface safety valve.
Figure 6B:
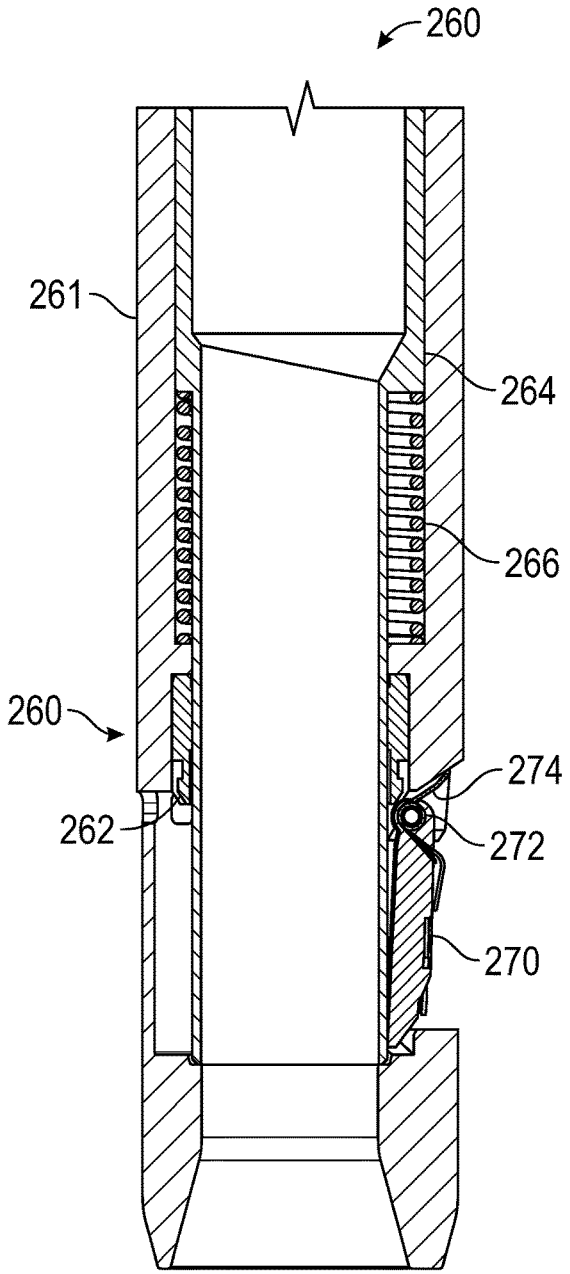

Pressurized hydraulic fluid can now be delivered through the at least one control line (30*a-b*; FIGS. 1A-1B), through the stinger 100, and into the stinger's actuator 160. As the fluid reaches the actuator 160, it can force the internal rod piston 164 to move the key 168 downward and shift the flow tube 264 against the bias of the spring 266 to pivot the flapper 270 open, as shown in FIGS. 6A-6B. In this way, the operator 260 can operate in a conventional manner between two functions. As long as hydraulic pressure is supplied and maintained to the actuator 160 via the at least one control line (30*a-b*; FIGS. 1A-1B), for example, the flow tube 264 maintains the flapper 270 open, thereby permitting fluid communication through the valve's housing 202. Moreover, flow can travel through the flow bore 105 of the stinger 100 with fewer internal restrictions inside the flow bore from the stems 161*a-b* and couplings 150, which can reduce turbulence.

When hydraulic pressure is released due to an unexpected up flow or the like, hydraulic pressure in the at least one control line (30*a-b*; FIGS. 1A-1B) can be released, relieved, or reversed. At this, the spring 266 moves the flow tube 264 away from the flapper 270, and the flapper 270 is biased shut by its torsion spring, thereby sealing fluid communication up through the valve's housing 202 as shown in FIGS. 4C-4D. In this sense, the closing of the safety valve's operator 260 can move and reset the stinger's actuator 160, which may merely allow for the reset due to the purposeful release of pressure. Of course, in other scenarios, the stinger's actuator 160 can be actively reset with pressure control to assist or regulate the closing of the valve's operator 260.

As will be appreciated, the hydraulic connections at 161*a-b* to the double control lines 30*a-b* in FIGS. 1A-1B connected to the surface allow the system to be insensitive to the setting depth. In particular, the single rod piston 164 connected to pressure differential between the opposing pressure of the control lines (30*a-b*) with seal stacks 165*a-b* in opposite directions allows the system to be insensitive to tubing pressure. The two control lines (30*a-b*) can reduce the need for a heavy spring in the safety valve 200. Overall, this can reduce the length required for the safety valve 200 and can simplify its components. Likewise, the pump pressure required at surface can be advantageously reduced. Moreover, if a piston seal 165*a-b* on the rod piston 164 fails or if a control line (30*a-b*) fails, personnel only need to pull the stinger 100 out of the well for repair. There is no need to pull out the safety valve 200.

As noted previously, the primary control line (30*a*) can be pressurized. The balance control line (30*b*) can be connected to an oil reserve/tank configured to the pressure for the depth at which the valve 200 is to be set so that it is insensitive to the desired setting depth. Alternatively, the balance control line (30*b*) can be pressurized and can be used to deal with scale and/or debris in the lines (30*a-b*). If the flow tube 264 becomes stuck in the safety valve 200, personnel can alternatingly pressurize the control lines (30*a-b*) to exercise the flow tube 264 in the valve 200 so scale and/or debris can be removed.

Figure 8A:
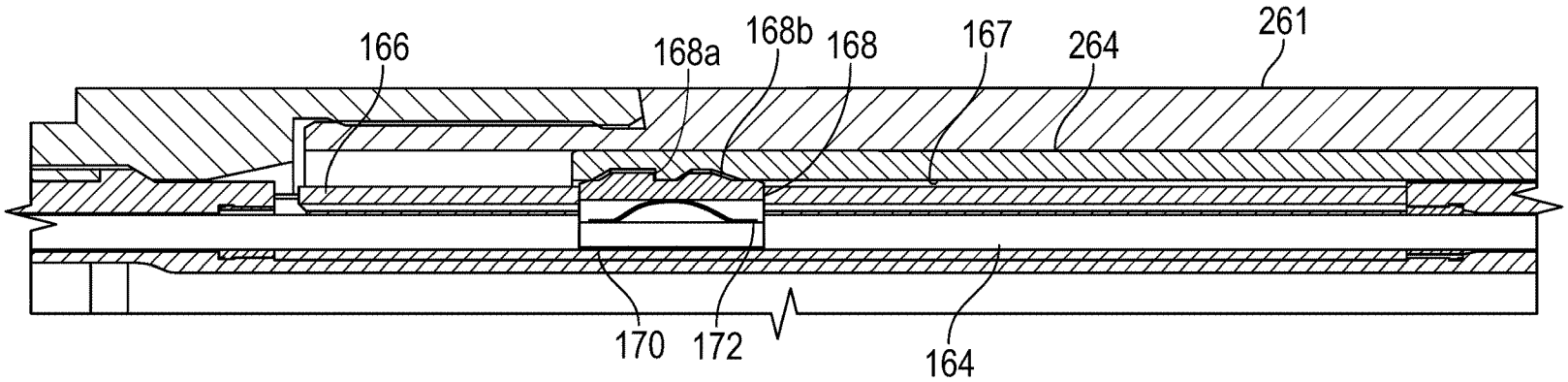
FIGS. 8A-8D illustrate various views of the actuator of the disclosed stinger.
Figure 8D:
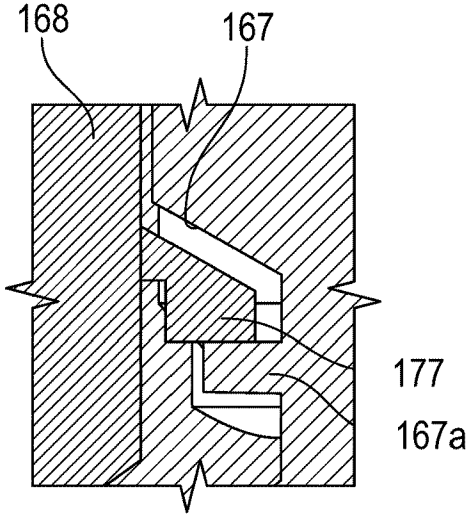
Figure 8C:
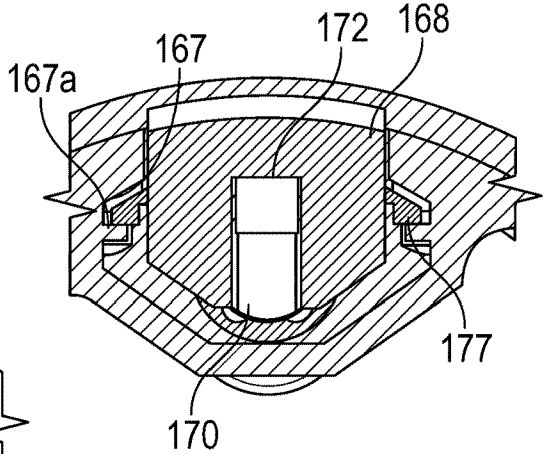
Figure 8B:
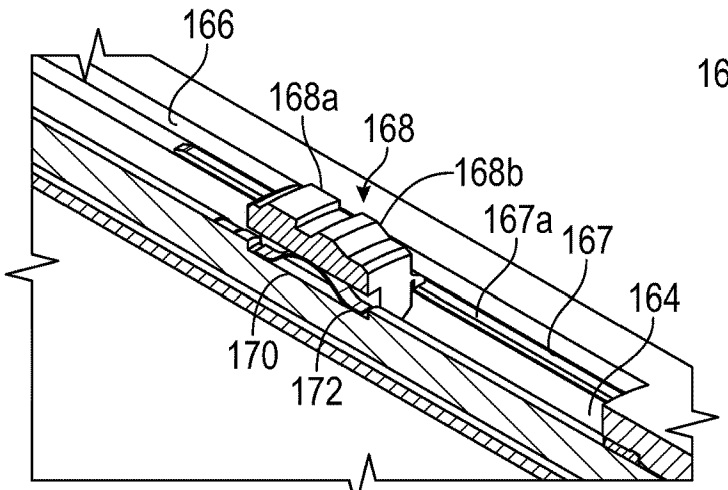

FIGS. 8A-8D illustrate various views of the actuator 160 of the disclosed stinger (100), exposing details of the piston 164, the key 168, and the like. In particular, FIG. 8A shows a cross-section of the key 168 of the actuator 160 engaged with the key profile 268 of the valve's flow tube 264 with the piston 164 at least partially shifting the flow tube 264 on the valve (200). FIG. 8B is a perspective of a portion of the actuator 160 in cross-section, revealing features of the piston 164, the key 168, and the slot 166 in the actuator 160. FIG. 8C is an end-section of a portion of the actuator 160, showing features of the piston 164, the key 168, and the slot 166 in the actuator 160. Finally, FIG. 8D is a detail of the end-section in FIG. 8C.

In the figures, the slot 166 is defined in the main body of the actuator's sleeve 162, and tracks 167 are defined along the sides of the slot 166. Each of the tracks 167 has a bottom surface or ledge 167*a*. The key 168 has rails or wings 177 that extend from the sides of the key 168. These rails 177 can ride in the tracks 167.

As noted herein, the key 168 is disposed on the piston 164 so that the key 168 can move with the piston 164. As shown in FIGS. 8A-8C, a longitudinal slot in the bottom of the key 168 can fit onto a reduced stem 170 that is part of the piston 164. A spring 172, such as a leaf spring, disposed between the key 168 and the stem 170 biases the key 168 to extend outward on the piston 164 beyond the slot 166 in the actuator's sleeve 162. As the sleeve 162 inserts into the safety valve (200), the biased key 168 can be retracted to prevent engagement with other elements. Eventually as shown in FIG. 8A, the male profile 168*a-b* of the key 168 faces the female profile of the safety valve's key 268 in the flow tube 264 so the stinger's key 168 can engage the valve's key profile 268.

The stinger's key 168 engages into the corresponding sleeve's key profile 268 in the valve's direction of motion (i.e., the downhole direction of motion of the valve's flow tube 264). The stinger's key 168 can use a suitable key profile, such as a WX type or equivalent type of profile, having a shoulder 168*a* and inclines 168*b*. In a particular arrangement, the shoulder 168*a* of the key's profile can be angled an amount (e.g., 5 degrees) downhole, and the tube's profile 268 can be comparably configured. In this way, the key 168 can remain engaged in the flow tube's profile 268 when opening/closing sequences are being performed. Yet, the inclines 168*b* of the profile can have appropriate angles (e.g., 45 degrees) that allow for disconnection when the actuator 160 is pulled out.

As further shown in FIGS. 8A-8D, the key 168 includes rails 177 that can ride in tracks 167 defined along the sleeve's slot 166. The rails 177 and tracks 167 limit the biased extension of the key 168 from the slot 166. A ledge 167*a* extends partially along the track 177 toward the downhole end. The ledge 167*a* limits the retraction of the key 168 from the flow tube's profile 268 when the key 168 and the piston 164 have been moved to an actuating position in the slot 166. The rails 177 of the key 168 engage the ledge 167*a* of the slot's track 167, which restricts how much the key 168 can retract away from the tube's profile 268. This can keep the key 168 engaged in the flow tube when the B line is actuated for exercising.

The key 168 can be sheared in case of emergency so the actuator 160 can be disconnected from the flow tube 264 of the safety valve (200). For example, the key 168 can be sheared by pressurizing the balance control line (30*b*) communicating with the second connection (150*b*) and/or by pulling the stinger 100 out of the valve 200. When done, the rails 177 of the key 168 disposed in the tracks 167 of the slot 166 as detailed in FIG. 8D can break by the force. This is especially the case when the rails 177 are restricted by the ledge 167*a* in the track 167 toward the downhole end of the slot 166.

Figure 9A:
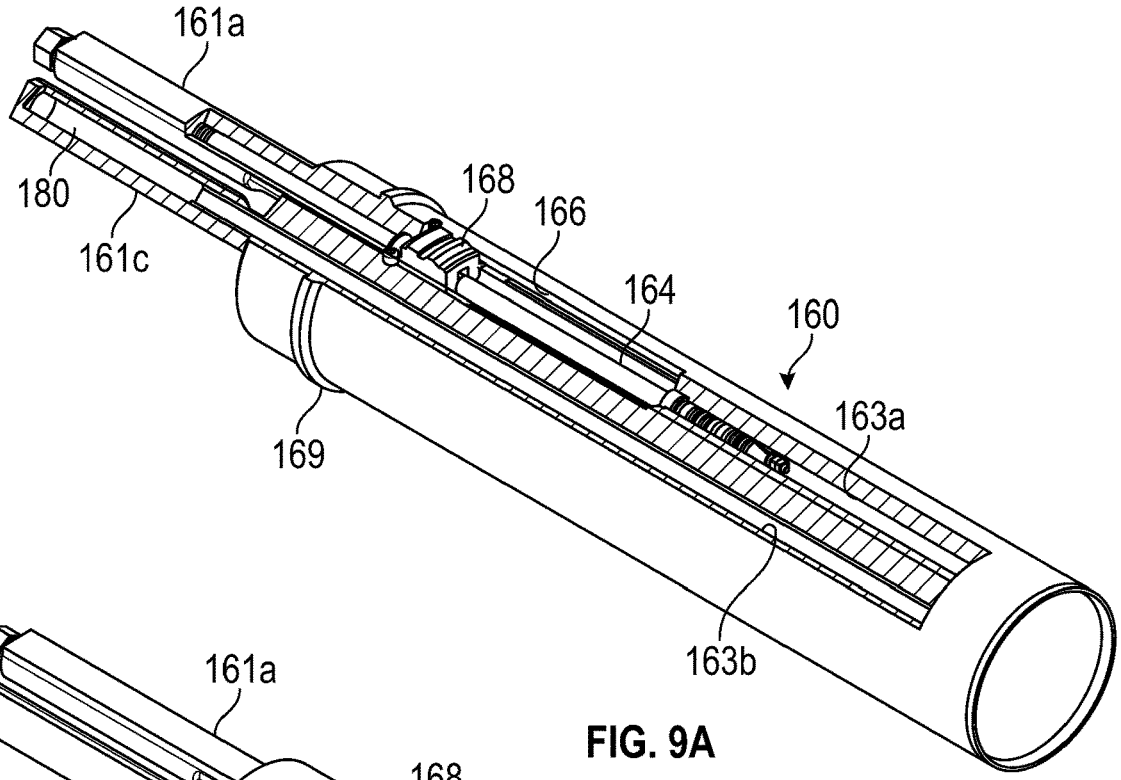
FIGS. 9A-9C illustrate perspective views of another actuator for the disclosed stinger having a control line connection and a pressure chamber.
Figure 9B:
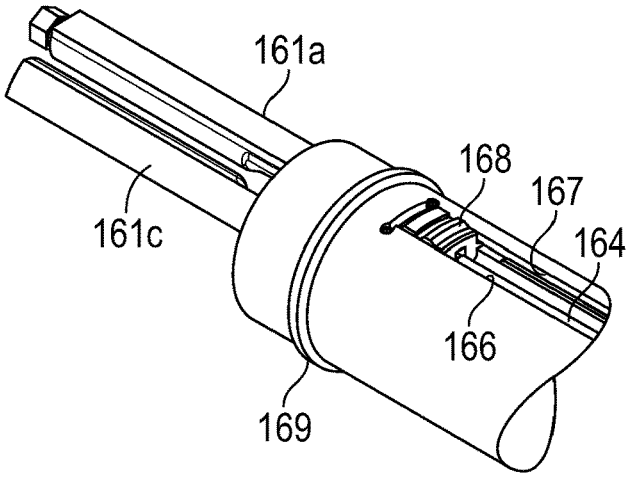
Figure 9C:
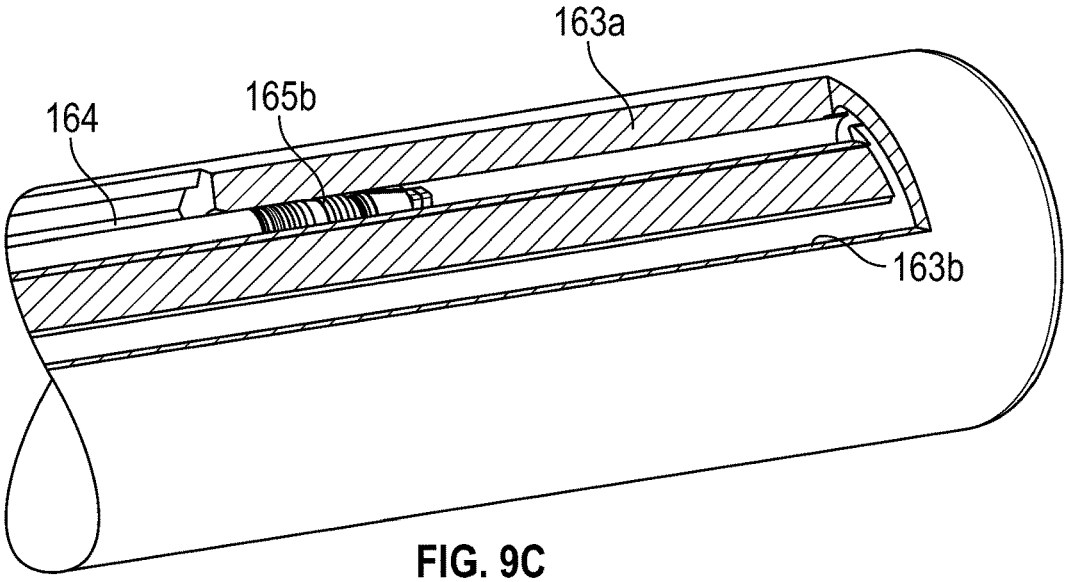

FIGS. 9A-9B illustrate perspective views of another actuator 160 for the disclosed stinger (100) having a control line connection 161*a* and a pressure chamber 180. In the previous arrangements, two control line connections were used to control the pressure differential against the actuator's piston 164. Here, one control line connection 161*a* connects to hydraulic pressure on one side of the piston 164. The piston chamber 163 on the other side of the piston 164 defines a pressure chamber 180. This chamber 180 can be preconfigured and may have a stem 161*c* for increased volume. Alternatively, the stem 161*c* may be an existing fluid connection stem (161*b*) as in previous embodiments that have been capped off and not connected to a conduit. Still further, if additional volume is needed, the stem 161*c* for the chamber 180 can be connected to a conduit (not shown) that runs a partial distance uphole, but does not pass to the surface. Instead, this conduit can be capped off at its end to define a closed volume for the chamber 180.

Depending on the implementation, the chamber 180 acting as a volume can be an atmospheric chamber, or the chamber 180 can be filled with a compressible fluid that is pressurized. Either way, the chamber 180 can balance the pressure in the main control line connected to the stem 161*a* on the first side of the piston 164. When filled with pressurized fluid, the balance provided by the pressurized chamber 180 can be configured for the setting depth of the safety valve 200 and the stinger 100. Using an atmospheric chamber is not intended to be setting depth insensitive.

Figure 10A:
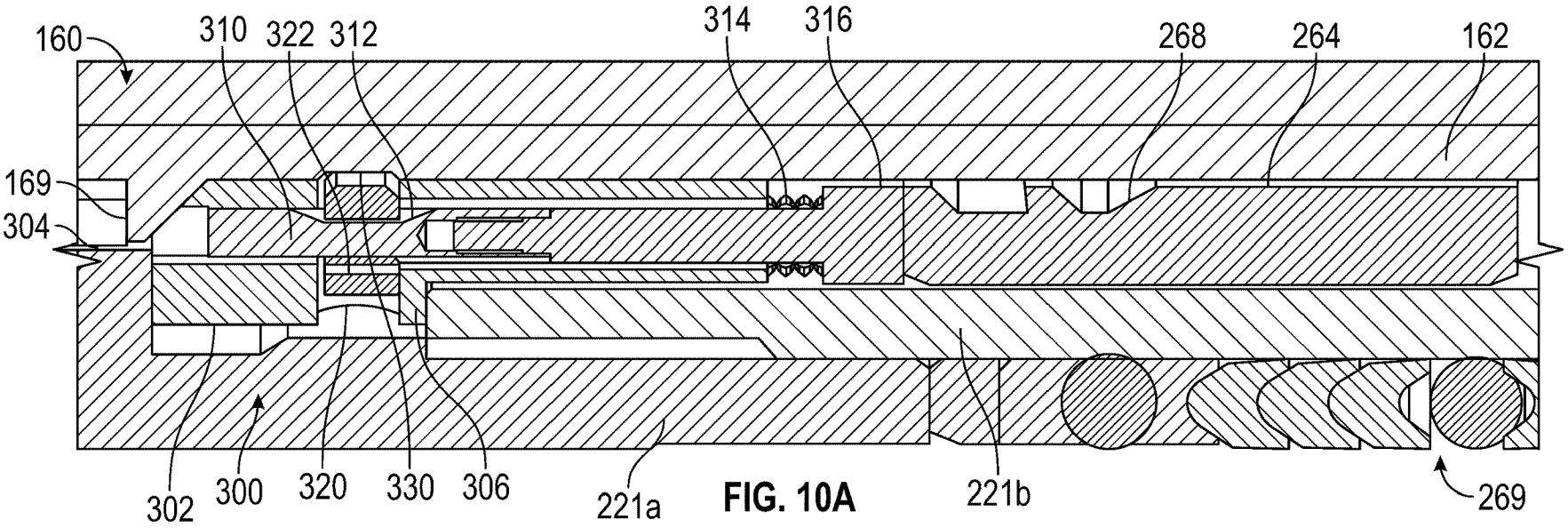
FIGS. 10A-10B illustrate detailed cross-section of another lock of the disclosed stinger.
Figure 10B:
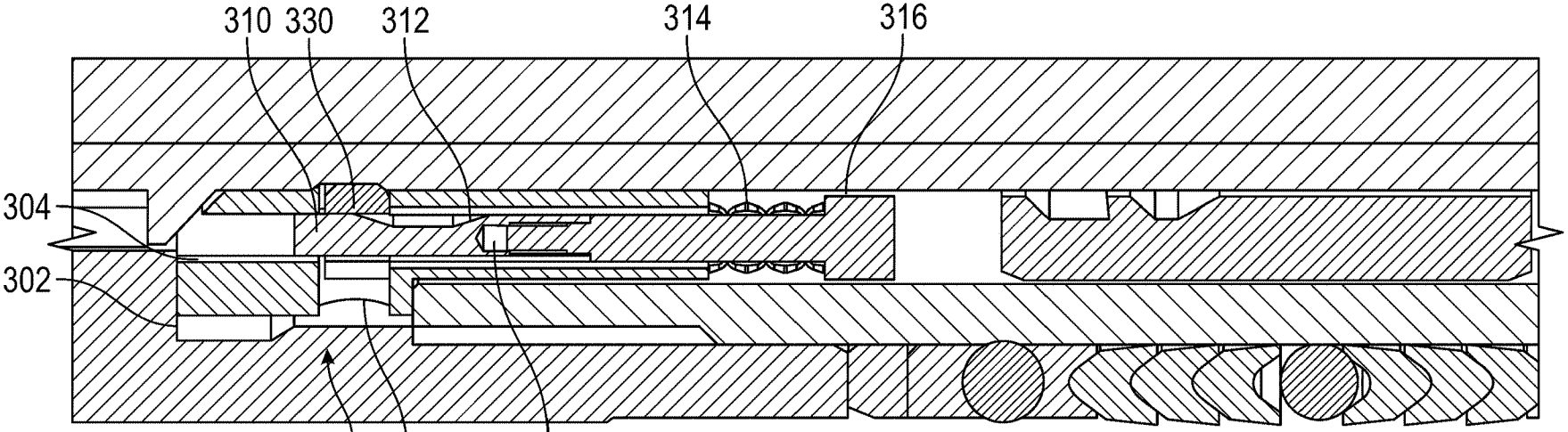

As noted with reference to FIG. 7, the stinger 100 can include a lock for engaging inside the valve 200, and/or the valve 200 can include a lock for engaging the stinger 100 therein. FIGS. 10A-10B illustrate detailed cross-sections of a lock mechanism 300 that can be used for locking the actuator 160 of the stinger 100 in a downhole tool. In FIG. 10A, the sleeve 162 of the actuator 160 is shown inserted into the tool's bore 205 such that the shoulder 169 on the actuator 160 shoulders inside the bore 205. The lock mechanism 300 includes a shoulder body 302, which can include a ring affixed in the tool 200 between coupled housing components 221*a-b*, such as those near the tool's external seals 269.

The lock mechanism 300 further includes a pin 310 and a dog 330 on the shoulder body 302. As will be appreciated, more than one combination of the pin 310 and the dog 330 can be disposed about the circumference of the tool 200 to provide multiple engagement points.

The shoulder body 302 defines an aperture 304 in which the pin 310 is movable. In turn, the pin 310 passes through a side aperture 322 in the dog 320. The pin 310 includes a notch 312 that can align with the side-facing dog 330, which allows the side-facing dog 330 to retract in a side slot 306 of the shoulder body 302 and remain disengaged from a dog profile 330 on the side of the actuator's sleeve 162. A head 316 of the pin 310 is biased by a spring 314 between the head 316 and the shoulder body 312.

As shown in FIG. 10A, the head 316 of the pin 310 shoulders against the end of the flow tube 264 when the stinger (100) is inserted into the valve (200) in its initial closed condition. In this state, the notch 312 of the pin 310 allows the dog 320 to be retracted from the dog profile 330 in the sleeve 162. The key (168) of the actuator 160 engages the key profile 268 of the tool (200) in a manner discussed previously. When pressure is applied to the actuator 160 in the manner discussed previously, the actuator's piston (164) moves the flow tube 264 further down (to the right in FIGS. 10A-10B) in the tool's bore 205.

As shown in FIG. 10B, the spring 314 shifts the pin 310 as the flow tube 264 moves. The notch 312 on the pin 310 moves out of alignment with the dog 320, and the dog 320 is pushed outward into the dog profile 330 on the sleeve 162. This engagement can help keep the stinger's actuator 160 in the tool's bore 205.

Release of the stinger's sleeve 162 can occur with the reverse of the above steps. In particular, when the pressure in the B line is used or otherwise when the bias of the spring 266 dominates, the actuator 160 moves the flow tube 264 uphole (to the left in FIGS. 10A-10B) in the tool's bore 205. The flow tube 264 eventually shoulders against the head 316 of the extended pin 310. The movement of the pin 310 then aligns the notch 312 with the dog 320 allowing the dog 320 to retract from the lock profile 330 on the stinger's sleeve 162, which can be withdrawn from the tool's bore.

As shown in FIGS. 10A-10B, the lock 300 can be installed in the safety valve for engaging a dog profile defined externally on the stinger. Provided that a number space is available, a reverse arrangement is possible in which the pusher and key mechanism are disposed on the stinger to engage in a dog profile defined internally on the safety valve.

As disclosed above, the stinger 100 of the present disclosure can be used for communicating hydraulics to actuate a downhole tool. As shown in the present examples, the downhole tool can be a surface-controlled, subsurface safety valve. As will be appreciated, the disclosed stinger 100 can be used with other tools.

Figure 11:
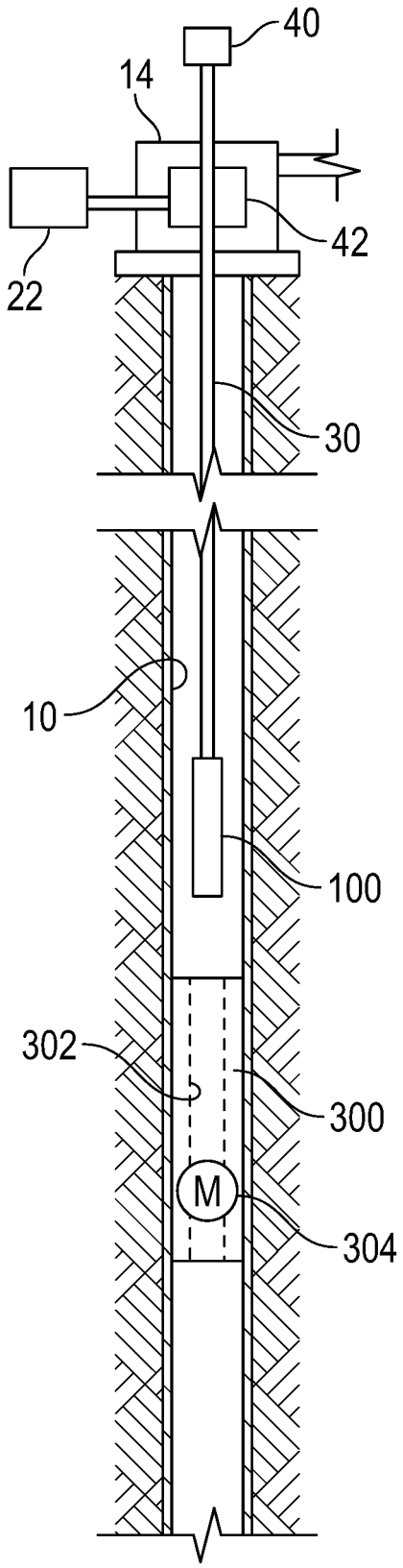
FIG. 11 illustrates a schematic view of the disclosed stinger during deployment to a mechanically-operated downhole tool.

For instance, FIG. 11 illustrates a schematic view of the disclosed stinger 100 during deployment to a mechanically-operated downhole tool 300. In general, the downhole tool 300 can be any mechanically-operated tool having a through-bore or bore opening 302 and having a mechanical operator 304, such as a sleeve, a valve, etc. The tool 300 is shown disposed with (i.e., disposed in association with, disposed on, or disposed in) tubing or casing 10. For example, the tool 300 can be run in and set in the tubing or casing 10 using setting features, such as used for the safety valve disclosed herein. Alternatively, the tool 300 can be run on the tubing or casing 10 during deployment of the tubing or casing 10.

Regardless of how the tool 300 is run and set, the stinger 100 is run through the wellhead 14 on a control line 30 hanging from a hanger arrangement 40, and the stinger 100 is run down through the tubing 10. At surface, the hanger arrangement 40 of the control line 30 lands in a head or a bowl 42 of the wellhead 14 so the hydraulic system 22 at surface can communicate with the control line 30 to control the downhole tool 300.

Downhole, the stinger 100 stabs into the bore opening 302 of the tool 300 to make the connection as disclosed herein. The tool 300, therefore, includes features similar to those disclosed herein with respect to the safety valve (200) for receiving the stinger 100. In general, for example, the tool 300 includes some form of upper shoulder in its bore opening (205), an internal groove (203) for engaging the stinger's lock (120), and a key profile (268) for communicating engagement with the key (168) of the stinger's actuator (160).

As disclosed herein, a control fluid, hydraulic fluid, or the like is delivered via at least one control line 30 to the stinger 100 at least partially inserted in a longitudinal flow bore of a mandrel, a safety valve, or another downhole tool. The stinger includes a longitudinal bore and stabs into the tool's flow bore. The stinger 100 is hydraulically actuated by fluid communication from the control line and mechanically actuates the downhole tool 300.

The stinger 100 locks on an internal diameter of the downhole tool 300 into which the stinger 100 is stabbed. The arrangement of the present disclosure reduces flow obstruction by putting the stinger 100 on the outside of the flow. As noted in the background, current methods use hydraulic coupling from an inserted control line to a hydraulic mechanism of the downhole tool. Here, the stinger 100 instead includes the hydraulic mechanism and mechanically actuates the downhole tool 300 so that sealing of hydraulic communication from the stinger 100 to the downhole tool 300 is not required.

The locking system uses compression springs (wave springs, wire springs, disc springs, etc.) and locking dogs. This increases the stability of the production flow, because of decreased turbulence.

Figure 12:
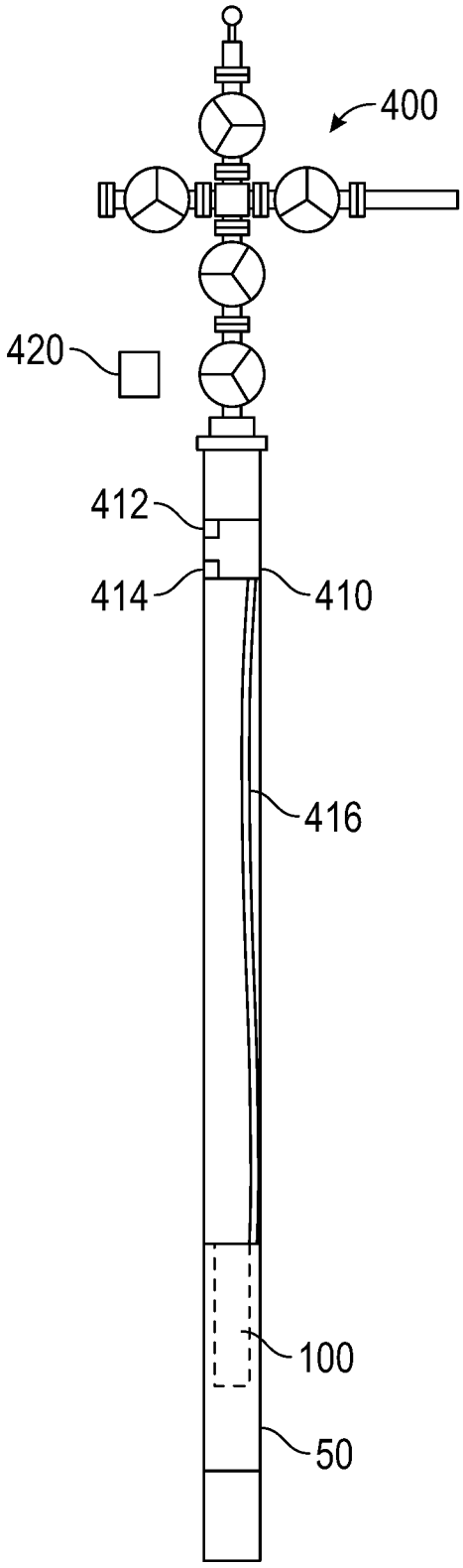
FIG. 12 illustrates an alternative configuration using the disclosed stinger in a downhole tool.

FIG. 12 illustrates another configuration for using the disclosed stinger 100 with a downhole tool 50, such as a surface-controlled, subsurface safety valve. The stinger 100 is connected to an electric pump 410 generating fluid pressure in at least one control line 416. A balance control line, a pressure chamber, or another configuration as disclosed herein can be used so the system is pressure insensitive.

The electric pump 410 can be controlled remotely from surface using a control unit 420 connected via wired or wireless connection to control circuitry 412 on the electric pump 410. Preferably, the electric pump 410 can be powered by a local power source 414, such as a battery and/or a generator. For example, the power source 414 can be a turbine that generates local power from the flow up the borehole. A "floating" E-line can be provided to allow simple pullout to replace batteries without removing the stinger 100 as the safety valve 200 remains always installed with this configuration. In this configuration, there is no need for a hanger arrangement or other modifications to the wellhead 400. Additionally, the hydraulic circuit is closed so there is no need to have a huge reservoir set with the pump 410.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A system used downhole in tubing having tubing flow and being operable with pressure communicated via at least one control line, the system comprising:

a tool disposed with the tubing and having a tool bore for passage of the tubing flow therethrough, the tool having an operator movable between first and second states, the operator having a first key disposed in the tool bore; and a stinger removably disposed in the tubing and configured to insert at least partially into the tool bore of the tool, the stinger defining a flow bore for passage of the tubing flow therethrough, the stinger having a piston disposed in a piston chamber in communication with the at least one control line, the piston having a second key disposed thereon, the piston being movable in the piston chamber in response to the pressure from the at least one control line, the stinger defining a slot adjacent the piston chamber, the second key disposed in the slot and being connected to the piston, the second key being movable with the piston between first and second positions, the second key configured to engage the first key of the tool and configured to move the operator at least from the first state to the second state.

2. The system of claim 1, wherein the operator of the tool comprises a valve being operable by the stinger to open from the first state to the second state, the valve in the first state restricting the tubing flow through the tool bore, the valve in the second state permitting the tubing flow through the tool bore.

3. The system of claim 2, wherein the valve comprises:

a flapper disposed in the tool bore and being pivotable between an opened position for the first state and a closed position for the second state relative to the tool bore; and a flow tube disposed in the tool bore and being movable therein between third and fourth positions to pivot the flapper respectively between the opened and closed positions, the flow tube defining a key profile exposed therein for the first key.

4. The system of claim 3, wherein the flapper comprises a torsion spring biasing the flapper toward the closed position; and wherein the flow tube comprises a compression spring biasing the flow tube toward the third position.

5. The system of claim 1, wherein the tool, being disposed with the tubing, is disposed on the tubing or is disposed in the tubing.

6. The system of claim 1, wherein the stinger comprises a first lock disposed thereon and being engageable in an internal groove in the tool bore; and/or wherein the tool comprises a second lock disposed in the tool bore and being engageable in an external groove on the stinger.

7. The system of claim 1, wherein the piston is sealed in the piston chamber of the stinger between a first of the at least one control line and a second of the at least one control line, wherein the piston is movable with a differential in the pressure between the first and second control lines.

8. The system of claim 1, wherein the piston is sealed in the piston chamber of the stinger between the at least one control line and a pressure volume, wherein the piston is movable with a differential in the pressure between the at least one control line and the pressure volume.

9. The system of claim 1, comprising a spring biasing the second key on the piston outward from the slot of the stinger.

10. The system of claim 1, wherein the second key comprises a male profile; and wherein the first key comprises a female profile, the male profile being configured to mate in a first direction with the female profile and configured to unmate from the female profile in a second direction opposite to the first direction.

11. The system of claim 1, further comprising a hydraulic apparatus having a first pump connected in communication with a first of the at least one control line, the first pump providing the pressure for a first side of the piston in the piston chamber.

12. The system of claim 11, wherein the hydraulic apparatus comprises:

a reservoir connected in communication with a second of the at least one control line, the second control line connected in communication with a second side of the piston in the piston chamber; or a second pump connected in communication with the second control line and providing the pressure for the second side of the piston in the piston chamber.

13. The system of claim 11, wherein the stinger further comprises a pressure volume being connected in communication with a second side of the piston in the piston chamber.

14. The system of claim 1, further comprising:

a power source disposed in the tubing; and an electric pump disposed in the tubing and disposed in electrical communication with the power source, the electric pump providing the pressure for the at least one control line.

15. A stinger for actuating a downhole tool using pressure communicated via at least one control line, the downhole tool disposed with tubing, the control line running through the tubing, the downhole tool having a tool bore for passage of tubing flow therethrough, the tool having an operator movable between first and second states, the operator having a first key exposed in the tool bore, the stinger comprising:

a body configured to insert at least partially into the tool bore of the downhole tool, the body defining a body bore for passage of the tubing flow therethrough, the body defining a piston chamber therein in communication with the at least one control line, a piston disposed in the piston chamber and being movable therein in response to the pressure; and a second key connected to the piston and being exposed on the body, the second key being engageable with the first key and being moved with the piston between first and second positions, whereby the second key engaged with the first key and moved from the first position to the second position is configured to move the operator at least from the first state to the second state.

16. The stinger of claim 15, wherein the piston is sealed in the piston chamber of the body between a first of the at least one control line and a second of the at least one control line, wherein the piston is movable with a differential in the pressure between the first and second control lines.

17. The stinger of claim 15, wherein the piston is sealed in the piston chamber of the body between the at least one control line and a pressure volume, wherein the piston is movable with a differential in the pressure between the at least one control line and the pressure volume.

18. The stinger of claim 15, wherein the stinger comprises a first lock or an external groove disposed on the stinger and being engageable with the tool.

19. The stinger of claim 15, wherein the body defines a slot adjacent the piston chamber, the second key disposed in the slot and being connected to the piston.

20. The stinger of claim 19, comprising a spring biasing the second key on the piston outward from the slot of the stinger.

21. The stinger of claim 15, wherein the second key comprises a male profile, the male profile being configured to mate in a first direction with the first key and configured to unmate from the first key in a second direction opposite to the first direction.

22. The stinger of claim 15, further comprising a hydraulic apparatus having a first pump connected in communication with a first of the at least one control line, the first pump providing the pressure fora first side of the piston in the piston chamber.

23. The stinger of claim 22, wherein the hydraulic apparatus comprises:

a reservoir connected in communication with a second of the at least one control line, the second control line connected in communication with a second side of the piston in the piston chamber; or a second pump connected in communication with the second control line and providing the pressure for the second side of the piston in the piston chamber.

24. The stinger of claim 22, wherein the stinger further comprises a pressure volume being connected in communication with a second side of the piston in the piston chamber.

25. The stinger of claim 15, further comprising:

a power source disposed in the tubing; and an electric pump disposed in the tubing and disposed in electrical communication with the power source, the electric pump providing the pressure for the at least one control line.

* * * * *